US011155284B2

(12) United States Patent
Vandermarel et al.

(10) Patent No.: US 11,155,284 B2
(45) Date of Patent: Oct. 26, 2021

(54) RAIL PORT INSERT

(71) Applicant: L.B. FOSTER RAIL TECHNOLOGIES, CORP., Burnaby (CA)

(72) Inventors: Joel Vandermarel, Vancouver (CA); David Elvidge, Maple Ridge (CA)

(73) Assignee: L.B. FOSTER RAIL TECHNOLOGIES, CORP., Burnaby (CA)

( * ) Notice: Subject to any disclaimer, the term of this patent is extended or adjusted under 35 U.S.C. 154(b) by 285 days.

(21) Appl. No.: 16/317,425

(22) PCT Filed: Jul. 14, 2016

(86) PCT No.: PCT/CA2016/050834
§ 371 (c)(1),
(2) Date: Jan. 11, 2019

(87) PCT Pub. No.: WO2018/010001
PCT Pub. Date: Jan. 18, 2018

(65) Prior Publication Data
US 2019/0322297 A1 Oct. 24, 2019

(51) Int. Cl.
*B61K 3/00* (2006.01)

(52) U.S. Cl.
CPC ..... *B61K 3/00* (2013.01)

(58) Field of Classification Search
CPC ..... B61K 3/00
See application file for complete search history.

(56) References Cited

U.S. PATENT DOCUMENTS 1,800,464 A * 4/1931 Metz ..... B61K 3/00 184/3.1
1,883,148 A * 10/1932 Warr ..... B61K 3/00 184/3.1

(Continued)

FOREIGN PATENT DOCUMENTS

EP 0027983 5/1981
GB 2446949 8/2008

(Continued)

OTHER PUBLICATIONS

International Search Report and Written Opinion issued in application No. PCT/CA2016/050834, dated Jan. 27, 2017, 8 pages.

*Primary Examiner* — Michael A Riegelman
(74) *Attorney, Agent, or Firm* — Clark Hill PLC; Paul D. Bangor, Jr.

(57) ABSTRACT

A rail port insert is provided. The insert comprises an outer casing comprising a tubular sidewall and a base, the sidewall and base defining a spatial volume therein, the base defining an inlet passage that extends through the base and that is fluid communication with the spatial volume, and an elastomeric body having a first end and a second end, the elastomeric body disposed within the spatial volume and affixed to an inner surface of the tubular sidewall, the base, or both an inner surface of the tubular sidewall and the base. The elastomeric body comprising a flow passageway having a length extending from the first end to the second end, the first end in fluid communication with the inlet passage of the base, the second end further comprising a depth-length and defining an orifice along the depth-length, the orifice moving from a closed position in the absence of any applied pressure within the flow passageway, to an open position when pressure is applied within the flow passageway. When the rail port insert is installed in a railhead port, the inlet of the outer casing is in fluid communication with a railhead (Continued)

conduit. Also provided is a method of inserting the rail port insert into a railroad outlet port, and use of the rail port insert.

20 Claims, 23 Drawing Sheets

(56) References Cited

U.S. PATENT DOCUMENTS

| | | | | | |
|---|---|---|---|---|---|
| 1,977,755 | A * | 10/1934 | Dudley | B61K 3/00 | 184/3.1 |
| 2,272,774 | A * | 2/1942 | McGarry | B61K 3/00 | 184/3.1 |
| 2,272,775 | A * | 2/1942 | McGarry | B61K 3/00 | 184/3.1 |
| 3,051,262 | A * | 8/1962 | Bettison | B61K 3/00 | 184/3.1 |
| 4,067,414 | A * | 1/1978 | Funke | F16K 7/00 | 137/846 |
| 4,214,647 | A * | 7/1980 | Lutts | B61K 3/00 | 184/3.1 |
| 4,524,805 | A * | 6/1985 | Hoffman | F16K 15/147 | 137/846 |
| 5,722,509 | A * | 3/1998 | Clinger | B61K 3/00 | 138/106 |
| 6,136,757 | A | 10/2000 | Chiddick | | |
| 6,742,624 | B2 * | 6/2004 | DiCarlo | B61K 3/00 | 104/279 |
| 6,759,372 | B2 | 7/2004 | Cotter | | |
| 6,855,673 | B2 | 2/2005 | Cotter et al. | | |
| 7,045,489 | B2 | 5/2006 | Cotter et al. | | |
| 7,160,378 | B2 | 1/2007 | Eadie et al. | | |
| 7,244,695 | B2 | 7/2007 | Eadie | | |
| 7,273,131 | B2 | 9/2007 | Urmson, Jr. et al. | | |
| 7,841,400 | B2 | 11/2010 | Wells et al. | | |
| 7,939,467 | B2 | 5/2011 | Heinemann et al. | | |
| 8,955,645 | B2 * | 2/2015 | Singleton | B61K 3/00 | 184/3.1 |
| 2002/0157901 | A1 | 10/2002 | Kast et al. | | |
| 2009/0000870 | A1 | 1/2009 | Holland | | |
| 2019/0322297 | A1 * | 10/2019 | Vandermarel | B61K 3/00 | |

FOREIGN PATENT DOCUMENTS

| | | |
|---|---|---|
| WO | WO 02/26919 | 4/2002 |
| WO | WO 2010/138819 | 12/2010 |
| WO | WO 2011/143765 | 11/2011 |
| WO | WO 2013/067628 | 5/2013 |

* cited by examiner

RAIL PORT INSERT

CROSS-REFERENCE TO RELATED APPLICATION

This patent application is a PCT national phase application under 35 U.S.C. 371 and claims priority to PCT/CA2016/050834 which was filed Jul. 14, 2016 and entitled "Rail Port Insert", the disclosure of which is incorporated herein in its entirety by reference.

TECHNICAL FIELD

The present disclosure relates to a rail port insert. The present disclosure also relates to a method of installing the rail port insert into a rail head port, and to a use of the rail port insert.

BACKGROUND

In the operation of railroads, lubricants or other friction modifying materials are applied onto desired, targeted portions of the railroad rails, on tangent portions, at curves, turnouts, or switches, such as the top of rail, at a gauge corner, or gauge face of a rail head. Friction modifying materials may either reduce or increase the friction between the railroad rail and train wheels, where necessary, to improve train performance and reduce wear on both the rails and the train wheels. Examples of such friction modifying materials may include, but are not limited to, those disclosed in U.S. Pat. Nos. 6,136,757, 6,855,673, 6,759,372, 7,939,467, 7,244,695, 7,160,378, 7,045,489, WO 02/26919 (which are herein incorporated by reference).

Various methods of delivering lubricants or other friction modifying materials onto a railroad rail are known in the art. For example, applicators may be mounted to the gauge face or the field face of the railroad rail and triggered to apply friction modifying materials, including lubricants, onto the railroad rail before, as, or while a train passes over the location of the lubricant applicators (see, for example, WO 2010/138819, WO 2011/143765, GB 2,446,949, U.S. Pat. Nos. 7,273,131, 6,742,624, 8,955,645).

Outlet ports typically located on the top of rail, at a gauge corner, or gauge face of a rail head are also known for the delivery of grease or grease-like lubricants. As a train wheel passes over the location of the outlet ports, the grease or a grease-like lubricant is dispensed from the outlet ports and onto the railroad rail, and the friction characteristic between the railroad rail and the train wheels is modified. U.S. Pat. No. 4,214,647 describes an automatic rail greasing apparatus for dispensing relatively high-viscosity grease-like lubricant onto railroad rails. The lubricant passes directly through an outlet port located within a rail head, and onto the top surface of the rail head. A plastic tubular insert is disposed in the outlet port, and delivers grease or grease-like lubricant from a delivery tube connected to the outlet port onto the top surface of the rail head. EP 0027983 teaches the use of a metal nipple having at its outer periphery a conically-shaped protrusion that wedges into the side of the outlet port. The outlet face of these rail port inserts is open to the atmosphere in order to permit the rail/wheel surface access to the grease or grease-like lubricants. Due to the composition of the grease or grease-like lubricant used, drying due to evaporation and associated clogging of the port opening is negligible.

Liquid or water-based friction modifier compositions, as described in U.S. Pat. Nos. 6,136,757, 6,855,673, 6,759,372, 7,939,467, 7,244,695, 7,160,378, 7,045,489, WO 02/26919 (which are herein incorporated by reference), provide a range of friction modifying characteristics between a railroad head and a train wheel. After application of such products onto the railroad head, the water or other solvent within the product evaporates, and the friction modifier composition remains present on the railroad head as a thin, dry film. Due to the evaporation of water or other solvent, use of these products in open-faced, outlet ports located at the top of a rail, at a gauge corner or gauge face of a rail head, may lead to clogging of the railhead outlet ports and render the railhead outlet ports inoperable.

SUMMARY

The present disclosure relates to a rail port insert, a method of installing the rail port insert into a rail head port, and the use of the rail port insert.

A rail port insert is described herein. An example of the rail port insert (A) comprises, an outer casing comprising a tubular sidewall and a base, the sidewall and base defining a spatial volume therein, the base defining an inlet passage that extends through the base and that is fluid communication with the spatial volume, an elastomeric body having a first end and a second end, the elastomeric body disposed within the spatial volume and affixed to an inner surface of the tubular sidewall, the base, or both an inner surface of the tubular sidewall and the base, the elastomeric body comprising a flow passageway having a length extending from the first end to the second end, the first end in fluid communication with the inlet passage of the base, the second end further comprising a depth-length and defining an orifice along the depth-length, the orifice moving from a closed position in the absence of any applied pressure within the flow passageway, to an open position when pressure is applied within the flow passageway, so that, when the rail port insert is installed in a railhead port, the inlet of the outer casing is in fluid communication with a railhead conduit.

There is also provided the rail port insert as described above wherein at least a portion of the flow passageway is bevelled from the first end to the second end, so that when the orifice is in the closed position, a beveled conduit is formed that has a beveled length extending from the first end to a bottom of the depth-length. When the orifice is the closed position, the depth-length to beveled length ratio is from about 1:100 to about 50:1.

The elastomeric body of the rail port insert may be press-fit within the inner surface of the tubular sidewall, or the elastomeric body may comprise an extension at the second end, the extension passing through and overlapping a bottom surface of the base. The outer casing of the rail port insert described above may also comprise a threaded engagement circumscribing at least a portion of an outer surface of the tubular sidewall.

A method of inserting the rail port insert (A) as described above into a railhead outlet port is also provided. The method comprising inserting the rail port insert into the rail head outlet port, and coupling, or mechanically coupling, the rail port insert to the railhead outlet port. In the step of mechanically coupling, the rail port insert may be threadedly engaged within the railhead outlet port, or it may be press-fit within the railhead outlet port.

Also provided is a rail port insert (B) that comprises, an outer casing comprising a tubular sidewall and a base, the sidewall and base defining a spatial volume therein, the base defining an inlet passage that extends through the base and that is fluid communication with the spatial volume, a tubular retainer that is disposed within the spatial volume so that an outer wall of the retainer is affixed to an inner surface of the tubular sidewall, the tubular retainer defining an open top end and an open bottom end, an elastomeric body having a first end and a second end, the elastomeric body comprising a circular flange at the first end, the circular flange having an upper surface and a lower surface and: i) the elastomeric body is disposed within the retainer so that the upper surface of the circular flange sits against the bottom end of the retainer, and the lower surface of the circular flange sits against the base, or ii) the elastomeric body is disposed within the spatial volume so that the upper surface of the circular flange sits against a flange positioned on an inner wall of the outer casing and the lower surface of the circular flange sits against the upper end of the retainer, the elastomeric body comprising a flow passageway having a length extending from the first end to the second end, the first end in fluid communication with the inlet passage of the base, the second end further comprising a depth-length and defining an orifice along the depth-length, the orifice moving from a closed position in the absence of any applied pressure within the flow passageway, to an open position when pressure is applied within the flow passageway, so that, when the rail port insert is installed in a railhead port, the inlet of the outer casing is in fluid communication with a railhead conduit.

In the rail port insert (B), as described above, further the retainer may be press-fit so that the outer wall of the retainer is frictionally engaged within the inner surface of the tubular sidewall of the outer casing. Alternatively, the retainer may comprise a threaded engagement on an outer surface, and the outer casing comprises a corresponding threaded engagement circumscribing at least a portion of the inner surface of the tubular sidewall. Furthermore, the retainer may be cone shaped and outer surface of the retainer may be beveled from the top end to the bottom end, and the inner surface of the tubular sidewall is beveled forming an inverted cone that matingly engages the outer surface of the retainer.

Also provided herein is the rail port insert (B), wherein an inner wall at the top end of the retainer further comprises a circular flange that extends towards a center of the retainer, the flange defining an opening located above the orifice.

A method of inserting the rail port insert (B) as described above into a railhead outlet port is also provided. The method comprising inserting the rail port insert into the rail head outlet port, and coupling, or mechanically coupling, the rail port insert to the railhead outlet port. In the step of mechanically coupling, a threaded engagement on an outer surface of the retainer matingly engages a corresponding threaded engagement circumscribing at least a portion of the inner surface of the tubular sidewall, and tightening of the retainer forces the tubular sidewall against a wall of the railhead port.

Also provided herein is another example of a rail port insert (C). In this example, the rail port insert comprises an elastomeric body having a first end and a second end, a rigid outer layer fused to a resilient, flexible central core, the elastomeric body comprising a flow passageway within the central core, the flow passageway having a length extending from the first end to the second end, the first end defining an inlet in fluid communication with the flow passageway, the second end comprising a depth-length and defining an orifice along the depth-length and in fluid communication with the flow passageway, the orifice moving from a closed position in the absence of any applied pressure within the flow passageway, to an open position when pressure is applied within the flow passageway, so that when the rail port insert is installed in a railhead port, the inlet is in fluid communication with a railhead conduit.

The outer rigid layer of the rail port insert (C), as described above, may comprise a threaded engagement circumscribing at least a portion of an outer surface of the rigid outer layer.

A method of inserting the rail port insert (c) as described above into a railhead outlet port is also provided. The method comprising, inserting the rail port insert into the rail head outlet port, and coupling, or mechanically, coupling the rail port insert to the railhead outlet port. In the step of mechanically coupling, the rail port insert may be threadedly engaged within the railhead outlet port, or it may be press-fit within the railhead outlet port.

Since the orifice of the rail port insert as described herein is able to close when pressure of the friction modifying composition or lubricant within the flow passageway is reduced, then the friction modifying composition or lubricant within the flow passageway does not evaporate, or the rate of evaporation is reduced. By reducing or eliminating evaporation, this reduces or minimizes clogging or plugging associated with the use of water-based or solvent-based liquid friction modifier compositions that are designed to dry after application onto a steel surface, such as the rail head or wheel flange. Furthermore, a rail port insert characterized as having an orifice that closes is beneficial when used with lubricant based materials, or solvent-based lubricant materials, such as oil, grease, or a combination thereof, since the closing orifice reduces plugging or clogging of the railhead port that would result from the combination of the lubricant with dust, sand, stone or other debris present in the environment of the rail.

This summary does not necessarily describe the entire scope of all aspects of the disclosure. Other aspects, features and advantages will be apparent to persons of ordinary skill in the art upon review of the following description of specific embodiments.

BRIEF DESCRIPTION OF THE DRAWINGS

In the accompanying drawings, which illustrate one or more exemplary embodiments.

DETAILED DESCRIPTION

Figure 1A:
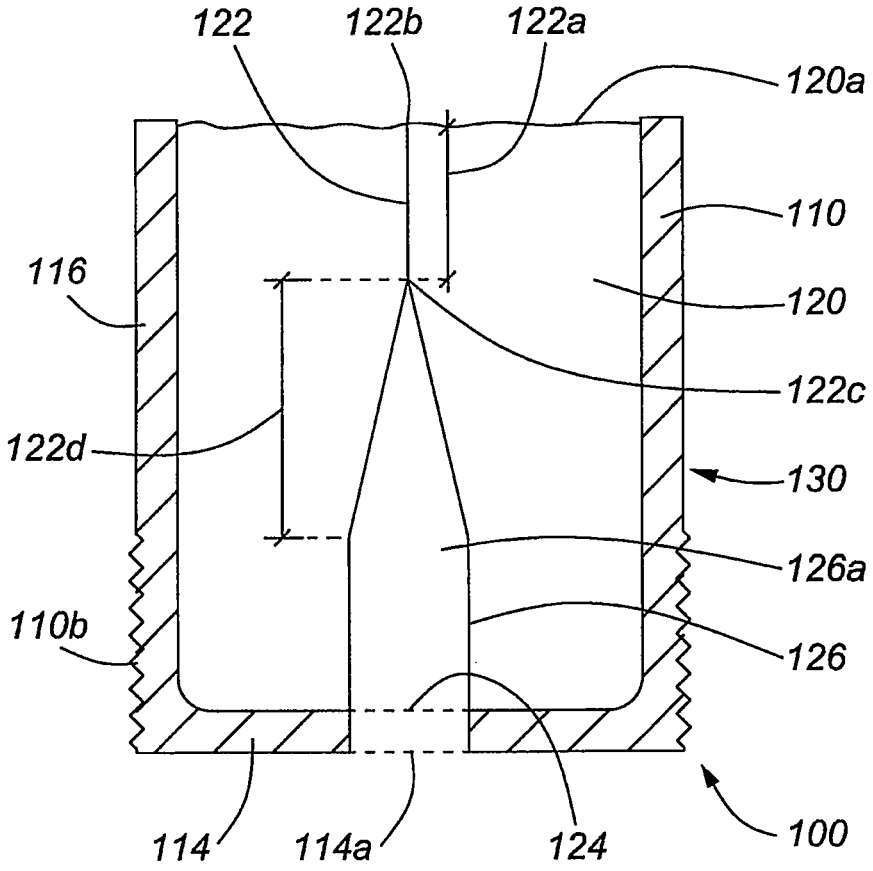
FIG. 1A is a cross-sectional front view of an example of a rail port insert described herein. In this example, the rail port insert comprises an outer casing defining a spatial volume, and an elastomeric body that is press-fit into the spatial volume of the outer casing. The elastomeric body comprises an inlet and a flow passageway that connects the inlet to an orifice. As depicted in this figure, the orifice of the elastomeric body is in a closed position.

The present disclosure relates to a rail port insert, a method of installing the rail port insert into a rail head port, and the use of the rail port insert.

Directional terms such as "top," "bottom," "upwards," "downwards," "vertically," and "laterally" are used in the following description for the purpose of providing relative reference only, and are not intended to suggest any limitations on how any article is to be positioned during use, or to be mounted in an assembly or relative to an environment. The use of the word "a" or "an" when used herein in conjunction with the term "comprising" may mean "one," but it is also consistent with the meaning of "one or more," "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

As used herein, the terms "comprising," "having," "including" and "containing," and grammatical variations thereof, are inclusive or open-ended and do not exclude additional, un-recited elements and/or method steps. The term "consisting essentially of" when used herein in connection with a composition, use, or method, denotes that additional elements, method steps or both additional elements and method steps may be present, but that these additions do not materially affect the manner in which the recited composition, method or use functions. The term "consisting of" when used herein in connection with a composition, use, or method, excludes the presence of additional elements and/or method steps.

As used herein, the term "open", when referring to an orifice of an elastomeric body, means that the one or more side surfaces that form the orifice are not contiguous with each other, but separated, and that lubricant or other friction modifying material is able to pass through the orifice when in its open configuration. The term "closed", when referring to the orifice of an elastomeric body, means that the sides surfaces forming the orifice are pressed against each other and they are contiguous, so that is the absence of any added pressure exerted on a lubricant or other friction modifying material, the lubricant or material is not able to pass through the orifice.

The present disclosure provides a rail port insert that reduces or minimizes clogging or plugging that is otherwise experienced by a railhead outlet port after friction modifier materials or lubricants, for example, a solvent-based, or water-based liquid friction modifier materials or lubricants, are dispensed therefrom.

Friction modifier compositions, may include for example but are not limited to compositions as described in U.S. Pat. Nos. 6,136,757, 6,855,673, 6,759,372, 7,939,467, 7,244,695, 7,160,378, 7,045,489, WO 02/26919 (which are herein incorporated by reference). Lubricant based compositions may include solvent based lubricants, oil, grease, or a combination thereof.

As described in more detail below, an example of the rail port insert comprises an outer casing having a tubular sidewall and a base, an inlet passage that extends through the base, and an elastomeric body having a first end and a second end and affixed to an inner surface of the tubular sidewall, the base, or both an inner surface of the tubular sidewall and the base. The elastomeric body comprises a flow passageway having a length extending from the first end to the second end, the first end in fluid communication with the inlet passage of the base, the second end further comprising a depth-length and defining an orifice along the depth-length. The orifice of the elastomeric body capable of moving from a closed position in the absence of any applied pressure within the flow passageway, to an open position when pressure is applied within the flow passageway. When the rail port insert is installed in a railhead port, the inlet of the base of the outer casing is in fluid communication with a conduit within a railhead. The conduit is in fluid communication with a friction modifying composition or lubricant delivery system that supplies the friction modifying composition or lubricant from as storage location to the railhead port.

The rail port insert may further comprise a retainer that secures the elastomeric body to the outer casing, that secures the outer casing to the railhead port, or that secures the elastomeric body to the outer casing and the outer casing to the railhead port.

Figure 3A:
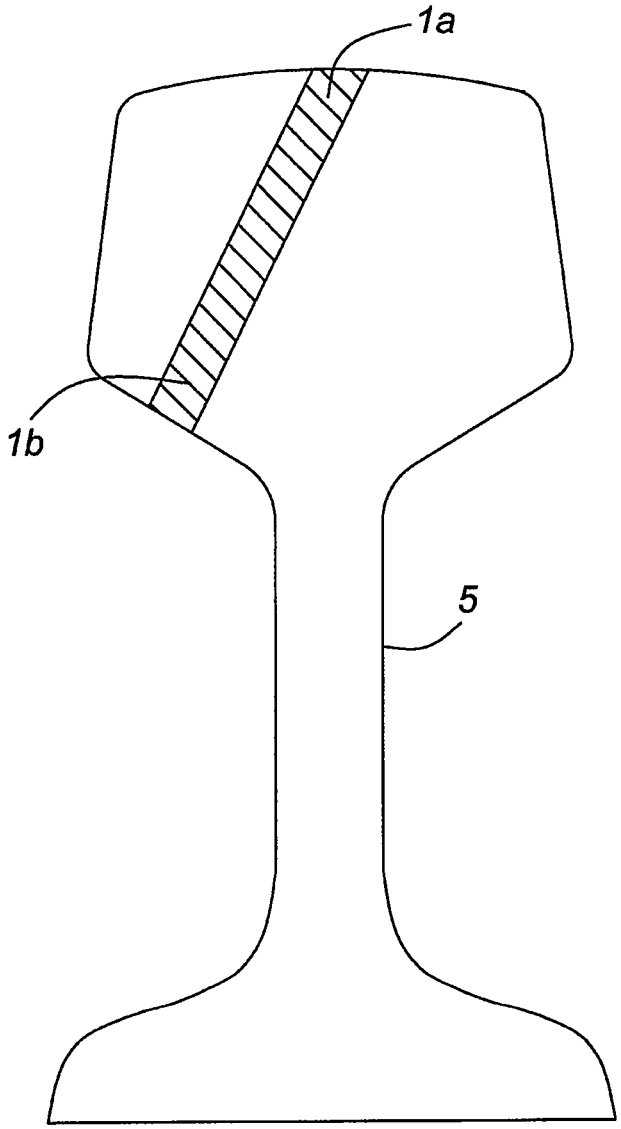
FIG. 3A shows a cross section of a rail comprising an example of a railhead port. The railhead port extends from the top surface of the railhead to an undersurface of the railhead. In this example, the railhead port may be drilled from either the top railhead surface, from the undersurface of the railhead, or from both the top and the undersurface of the railhead.
Figure 3B:
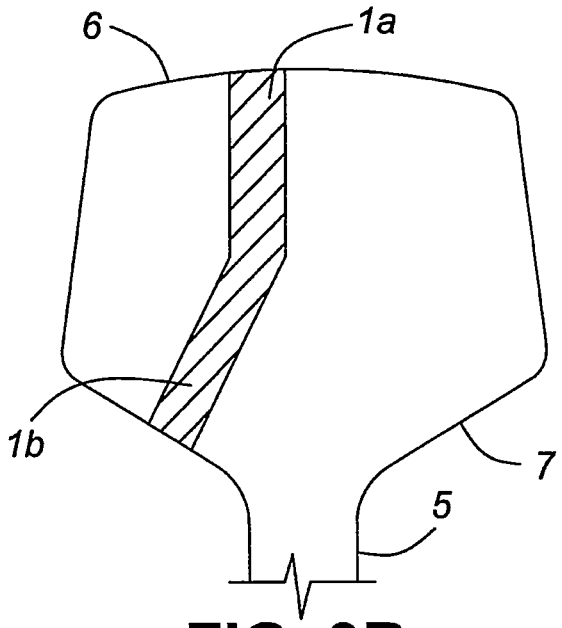
FIG. 3B shows a partial cross section of a rail comprising another example of a railhead port. In this example, the railhead port extends from the top surface of the railhead at a first angle, and partway through the railhead, the port extends to an undersurface of the railhead at a second angle. In this example, the railhead port is drilled from the top railhead surface and from the undersurface of the railhead.
Figure 3C:
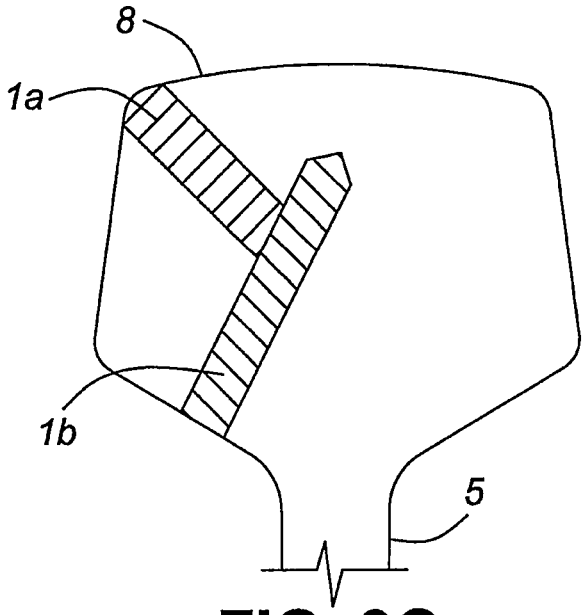
FIG. 3C shows a partial cross section of a rail comprising another example of a railhead port. In this example, the railhead port extends from the gauge face surface of the rail of the railhead, or the gauge corner surface of the railhead at a first angle, and partway through the railhead, the port extends to an undersurface of the railhead at a second angle. In this example, the railhead port is drilled from the top railhead surface and from the undersurface of the railhead.
Figure 4A:
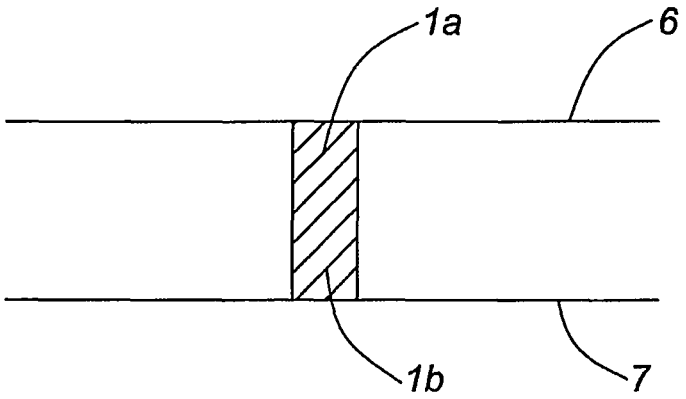
FIG. 4A shows a cross sectional side view of a railhead comprising an example of a railhead port. The railhead port is perpendicular with respect to the top surface and extends from the top surface of the railhead to an undersurface of the railhead. In this example, the railhead port may be drilled from either the top railhead surface, from the undersurface of the railhead, or from both the top and the undersurface of the railhead.
Figure 4B:
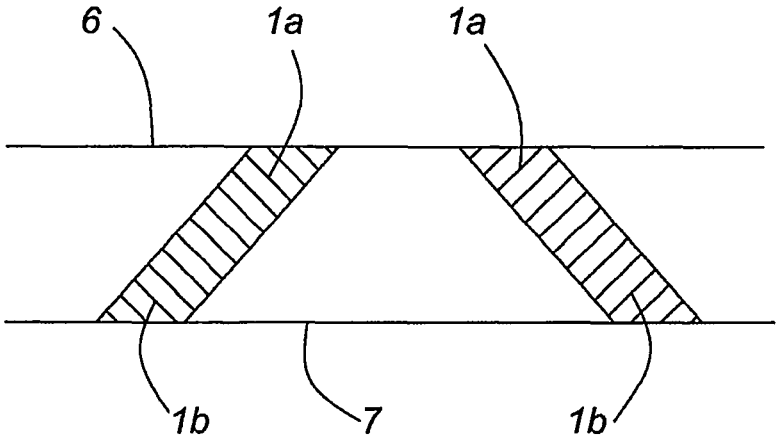
FIG. 4B shows a cross sectional side view of a railhead comprising two additional examples of a railhead port. In these examples, each of the railhead ports is at an angle with respect to the top surface of the railhead, and extends from the top surface of the railhead to an undersurface of the railhead. The railhead may comprise one or more of the railhead ports as shown.

The rail port insert is of a size that it may be inserted within an existing railhead port or a new railhead port. The new or existing railhead port may be positioned with an opening in the top surface of a railhead 6, the gauge face of the rail, or the gauge corner 8 of the rail (see FIGS. 3A-3C). The length of the railhead port within the rail head may be positioned at an angle that is perpendicular to the railhead surface (for example the top of rail surface, the gauge face surface, or the gauge corner surface), and extends from the top of the railhead surface 6 to the undersurface of the railhead 7, or the length of the railhead port may be positioned at another angle within the railhead as desired, and extend from the top of the railhead surface 6 to the undersurface 7, of the railhead 5 (see FIGS. 4A, 4B).

The diameter, depth, or both the diameter and depth, of the existing railhead port may be modified, for example the port may be drilled to have a larger diameter, or greater depth, or a new railhead port may be drilled into a railhead, and an appropriately sized rail port insert installed. For example the existing or new rail port insert may have a diameter from about 1 mm to about 25 mm or any amount therebetween, for example from about 1, 2, 3, 4, 5, 6, 7, 8, 9, 10, 11, 12, 13, 14, 15, 16, 17, 18, 19, 20, 21, 22, 23, 24, 25 mm, or any amount therebetween. For example, the new or existing railhead port may have a diameter from about 4 to about 8 mm, and a rail port insert as described herein and having a diameter from about 4 to 8 mm, may be installed within such a railhead port. The depth of the new or existing railhead port may be from about 5 to about 40 mm, or any amount therebetween, for example 5, 6, 7, 8, 9, 10, 12, 14, 16, 18, 20, 22, 24, 26, 28, 30, 32, 24, 26, 38, 40 mm or any amount therebetween.

Figure 1B:
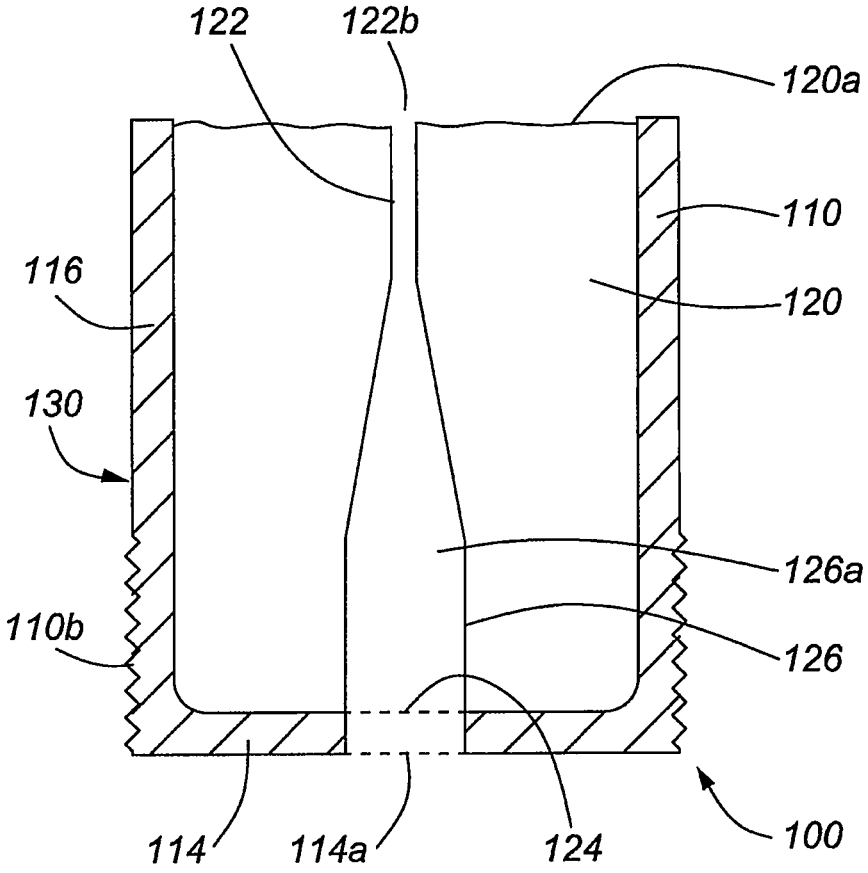
FIG. 1B is a cross-sectional front view of the example of a rail port insert depicted in FIG. 1A with the orifice of the elastomeric body in an open position.
Figure 1C:
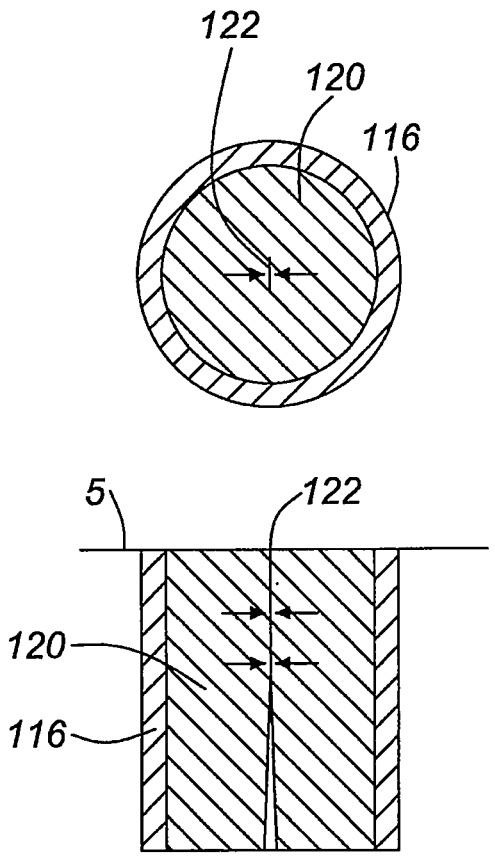
FIG. 1C is a top view (upper panel), and a cross-sectional view (lower panel), of an example of a rail port insert with the orifice in a closed position.
Figure 1D:
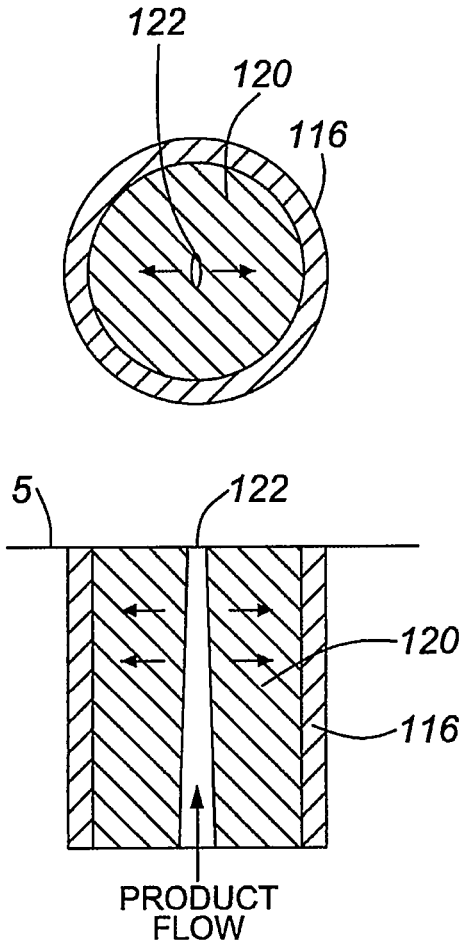
FIG. 1D is a top view (upper panel), and a cross-sectional view (lower panel) of the example of a rail port insert with the orifice in an open position.
Figure 1E:
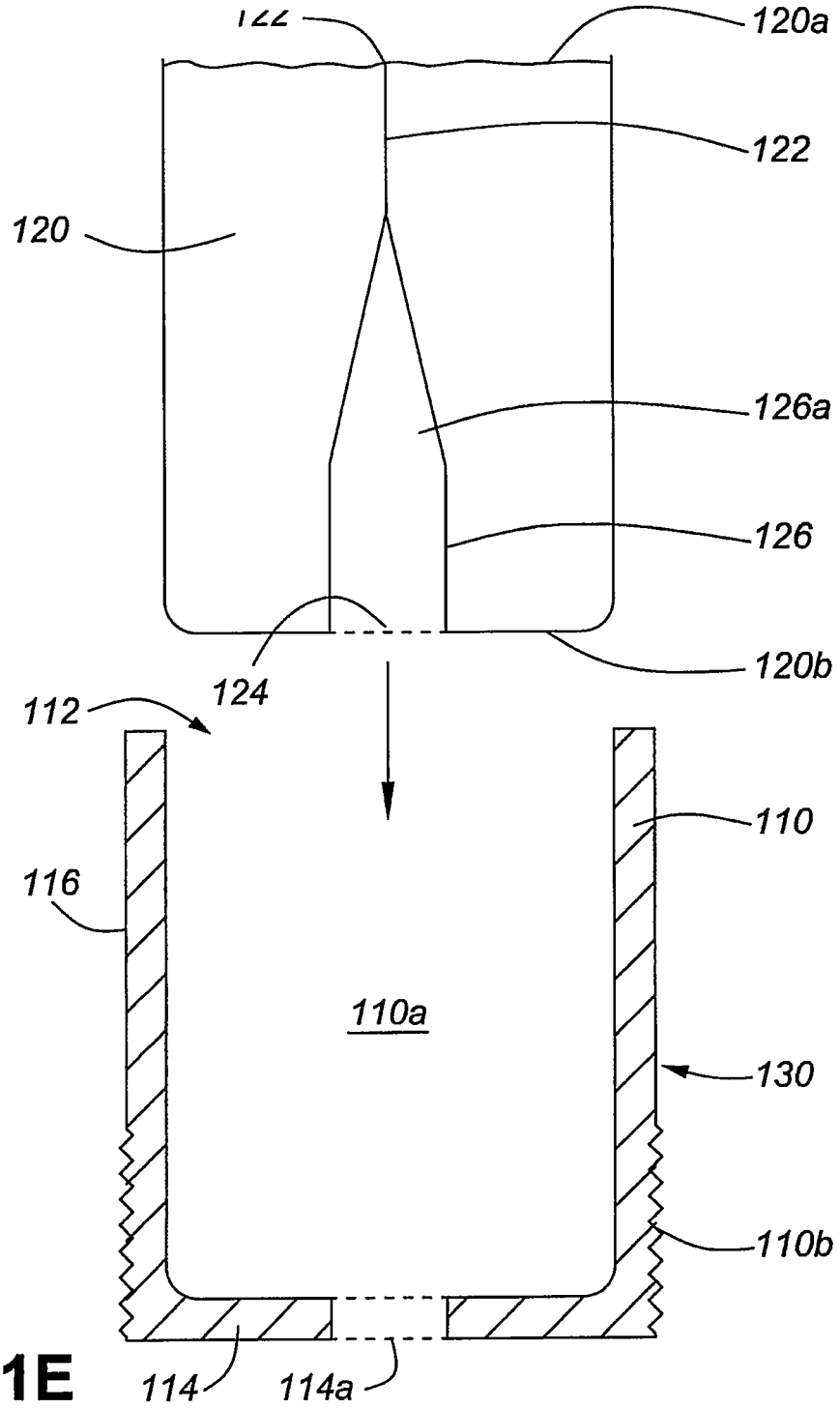
FIG. 1E is a cross-sectional exploded front view of the example of a rail port insert of FIG. 1A.
Figure 1F:
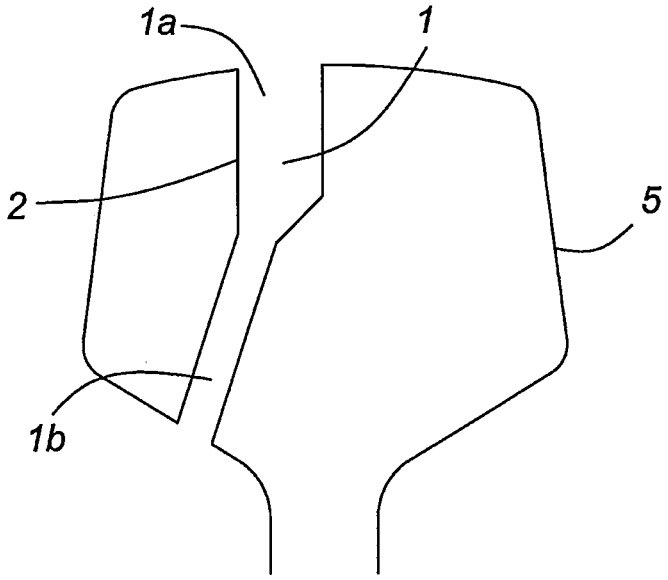
(PRIOR ART) FIG. 1F
FIG. 1F is a cross-section end view of a railhead comprising an outlet port (prior art).

The opening of the railhead port (la; for example as shown in FIG. 1F) may comprise a reset or chamfered edge, so that the edge is reset back from the outer diameter of the port opening from about 0 to about 8 mm, or any amount therebetween, for example from about 0, 0.5, 1.0, 2.0, 3.0, 4.0, 5.0, 6.0, 7.0, 8.0 mm or any amount therebetween. The amount of reset employed may depend upon the type of train or load, being transported along the track.

Also provided is a method of inserting any of rail port inserts, described herein, into a railhead outlet port. The method generally comprises inserting the rail port insert into the rail head outlet port 1, from either the top surface 6 of the railhead 5 (see FIG. 1G), or from the undersurface 7 of the railhead 5 (see FIG. 5), and coupling the rail port insert to the railhead outlet port. In the step of coupling, the rail port insert may be, for example, threadedly engaged within the railhead outlet port, it may be press-fit within the railhead outlet port, it may be tack-welded or welded within the railhead outlet port, it may be adhesively engaged with the railhead port outlet wall, or a retainer may be tightened to press the wall of the outer casing against the railhead port wall to secure the rail port insert within the railhead port. When required, the rail port insert may be removed using the reverse procedure as used for installation, or the insert may be drilled out, and a new rail port insert replaced. Furthermore, the reset or chamfered edge of the railhead port opening may need to be rejuvenated periodically, for example by drilling.

The rail port insert 100 is placed within the railhead port opening so that the top of the insert sits below or flush with, the top surface of the railhead. When inserted within the railhead, the distance from the top of the rail port insert 100 to the surface of the railhead is from about 0 to 20 mm or any amount therebetween, for example, from about 0, 1, 2, 3, 4, 5, 6, 7, 8, 9, 10, 11, 12, 13, 14, 15, 16, 17, 18, 19 20 mm or any amount therebetween.

Figure 1G:
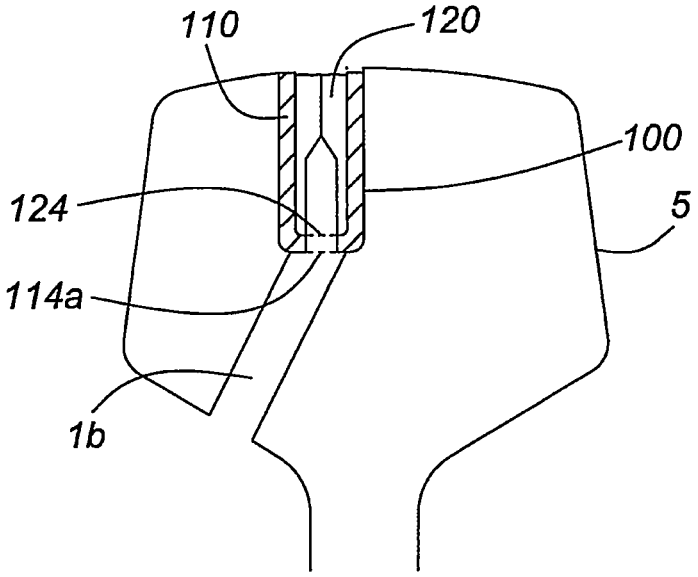
FIG. 1G is a cross-section end view of a railhead with a rail port insert threadedly engaged to the rail outlet port.
Figure 5:
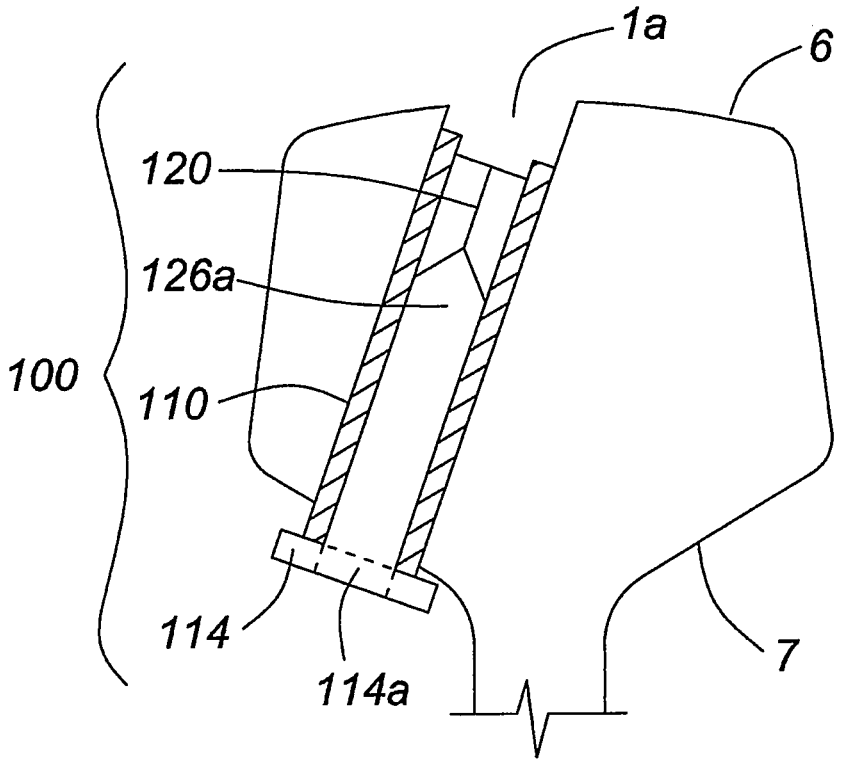
FIG. 5 shows a partial cross section of a railhead comprising a rail port insert that is inserted into the port from the bottom or undersurface of the railhead. In this example, the rail port insert comprises an elongate outer casing that extends the length of the railhead port. The elastomeric body is located at one end of the elongate rail port insert, adjacent the top surface of the railhead, and the base of the casing is positioned at the bottom or underside of the railhead.

Referring to the Figures, there is generally provided a rail port insert 100 comprising an outer casing 110 and an elastomeric body (a check valve) 120, as described above. The rail port insert 100 is for inserting into a railhead outlet port 1. The rail port insert 100 may be inserted within a railhead port 1 by inserting the rail port insert into the opening of the railhead port located on the top surface 6 of a railhead 5 as shown in FIG. 1G. Alternatively, the rail port insert 100 may be inserted within a railhead port 1 by inserting an elongate rail port insert into the opening of the railhead port located on the bottom or undersurface 7 of a railhead 5 (FIG. 5). In the example shown in FIG. 5, the base of the elongate rail port insert 114 may be connected to a source of a friction modifying composition or lubricant. In this way, the conduit of the rail port insert 1*b* is in fluid communication with the friction modifying composition or lubricant delivery system that supplies the friction modifying composition or lubricant from as storage location to the railhead port 1.

If the rail port insert 100 is inserted within the railhead so that the walls of the outer casing of the insert 116 are flush with the top of the railhead, then the opening defined by the top of the insert 110 (see FIG. 2H) may comprise a reset (or chamfered edge, not shown), relative to the outer diameter 115 of the main conduit traversing the insert 110*a*, so that the edge is reset back from the outer diameter 115 of the conduit from about 0 to about 8 mm, or any amount therebetween, for example from about 0, 0.5, 1.0, 2.0, 3.0, 4.0, 5.0, 6.0, 7.0, 8.0 mm or any amount therebetween. A non-limiting example of an insert comprising an edge at the top of the insert that is reset back from the outer diameter 115 of the main conduit is shown in FIG. 2H. The amount of reset employed may depend upon the type of train or load, being transported along the track.

The rail port insert 100 may be comprised of the elastomeric body 120 alone, and the elastomeric body 120 press-fit into a corresponding railhead port 1 from either the top surface 6 of the railhead 5, or from the bottom, or undersurface 7 of the railhead 5. The elastomeric body may also be made of two or more materials, for example, a rigid outer layer that is bonded or fused to, a resilient, flexible central core, and the rigid outer layer of the rail port insert may engage with the railhead port as described below.

A non-limiting example of a rail port insert is shown for example, in FIGS. 1A-1E, IJ and IK. The rail port insert 100 comprises an outer casing 110, which comprises an open end 112, a base 114 that is opposite the open end 112, a tubular sidewall 116 extending between the base 114 and the open end 112, and an inlet passage 114*a* that extends through the base 114. The tubular sidewall 116 and the base 114 define a spatial volume 110*a*. The outside surface 130, of sidewall 116 registers against the wall 2 of the railhead port 1 (FIG. 1F) when the rail port insert is secured or fastened within a railhead, as shown in FIG. 1G.

The outer casing 110 is manufactured of a material that is suitable for withstanding repeated impact by a rail car wheel and may include, but are not limited to, a metal, a metal alloy, fiber (for example, carbon fiber or glass fiber) reinforced plastic, or a plastic. In this example, threaded engagements 110*b* circumscribe at least a portion of the outer surface 130, of the outer casing 110 (for example as shown in FIG. 1A). Alternatively, threaded engagements 110*b* may circumscribe a lower portion, or extension, of the outer casing 110 as shown for example in FIG. 2A. The threaded engagements 110*b*, are for engaging complementary threaded engagements (not numbered) located within the railhead outlet port 1 of rail 5. If the railhead port does not comprise a complementary threaded engagement, then the existing railhead port may be modified so that a complementary threaded portion is introduced using standard procedures, for example by a tap, so that the railhead port may receive threaded engagement 110*b*.

The top surface of the outer casing 110 may comprises one or more slots or openings (not shown) for receiving an insertion tool, and that may be used for installing rail port insert 100 into, or removing rail port insert 100 from, railhead outlet port 1. For example, the top surface may have a slot into which an external apparatus (not shown) may register, and for example, turn insert 100 into the railhead outlet port 1 such that insert 100 threadedly engages the railhead outlet port 1.

Alternatively, insert 100 may engage outlet port 1 of railhead 5 by a locking mechanism or other method known in the art, for example a C-clip, a pin, an adhesive, by press fitting an oversized insert 100 into port 1 so that a frictional engagement is established between the outside surface 130 of sidewall 116, and wall 2 of railhead outlet port 1, or a combination thereof. The rail port insert 100 may further comprise a portion of the sidewall that protrudes above rail when installed and that comprises flats or tabs, that are used to install or tighten the rail port insert into the railhead port. After installation, the protruding portion may be removed, for example by grinding the protruding portion flush to the railhead surface. If elastomeric body, or check valve, 120 is made of two or more materials, for example, a rigid outer layer that is bonded or fused to, a resilient, flexible inner layer or central core, then in addition to the above mentioned attachment options, the rigid outer layer of the elastomeric body 120 may comprise threaded engagement 110*b* that engage corresponding threads in a railhead port 1, or the bi-layered the elastomeric body may be press-fit into railhead port 1.

Figure 1H:
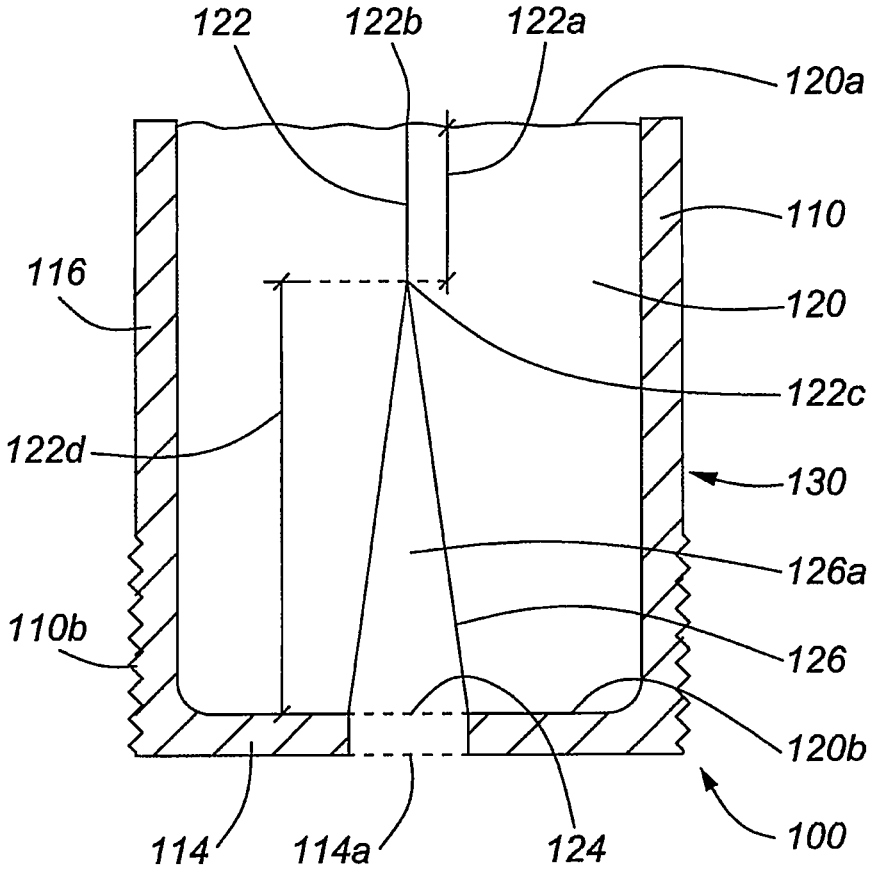
FIG. 1H is a cross-sectional front view of an example of an alternate rail port insert described herein. In this example, the rail port insert comprises an elastomeric body that is press-fit into the outer casing. The flow passageway of the elastomeric body is beveled from the base of the elastomeric body to the base of the orifice.
Figure 1I:
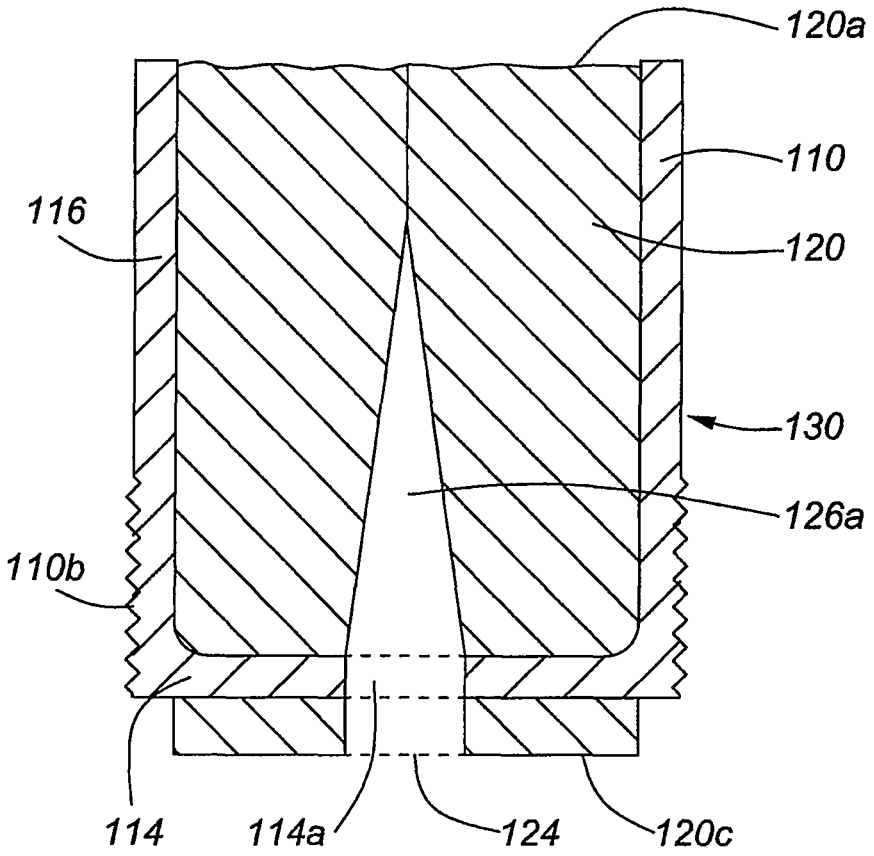
FIG. 1I is a cross-sectional view of an example of an alternate rail port insert described herein. In this example, the rail port insert comprises an elastomeric body that is press-fit into the outer casing so that the base of the body protrudes below the base of the outer casing.
Figure 1J:
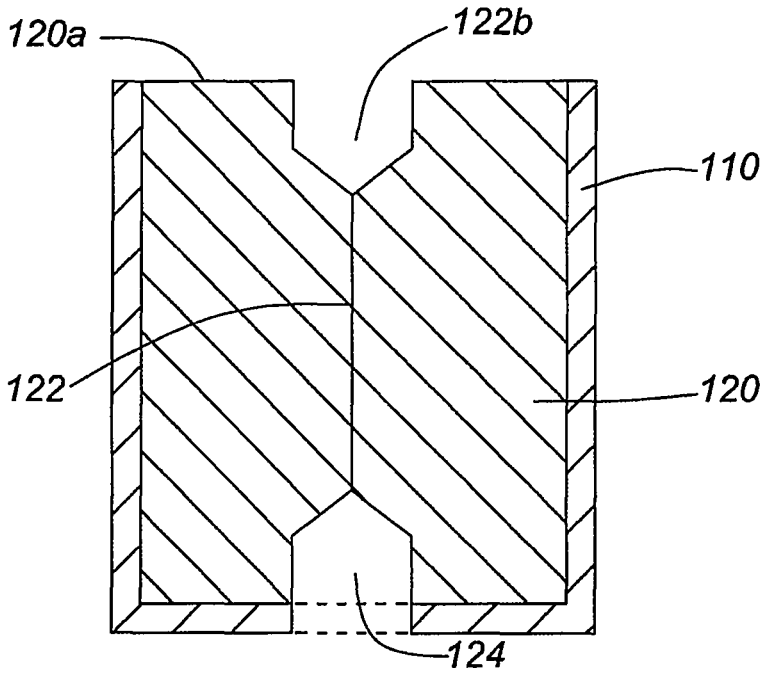
FIG. 1J shows a cross sectional of another example of an alternate rail port insert described herein. In this example, the rail port insert comprises a recessed portion located at the top of the orifice, and a recessed portion at the bottom of the orifice. The rail port insert may comprise one of either the top or bottom recessed portions, or both recessed portions as shown.
Figure 1K:
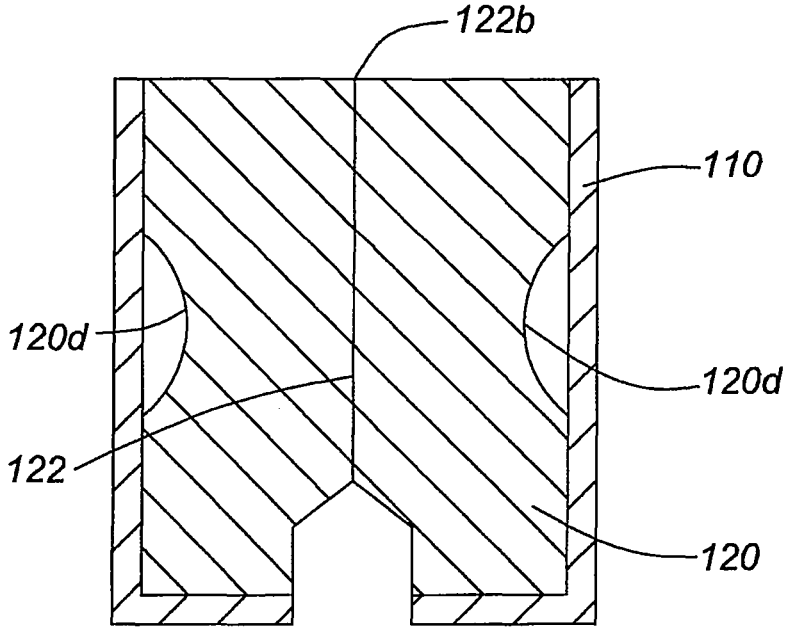
FIG. 1K is a cross-sectional view of an example of an alternate rail port insert described herein. In this example, the elastomeric body of the rail port insert comprises a relief zone that circumscribes the outer surface of the elastomeric body.
Figure 2A:
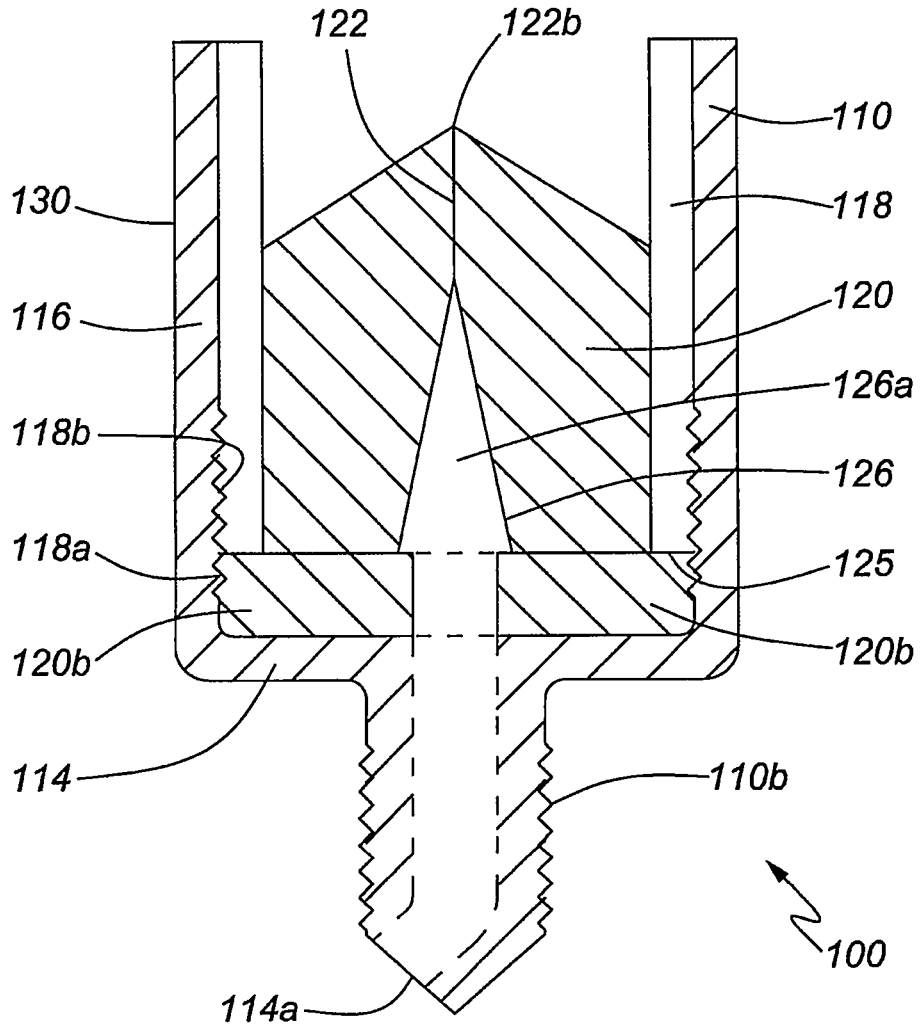
FIG. 2A is a cross-sectional front view of another example of a rail port insert as described herein comprising a retainer located within the outer casing.
Figure 2B:
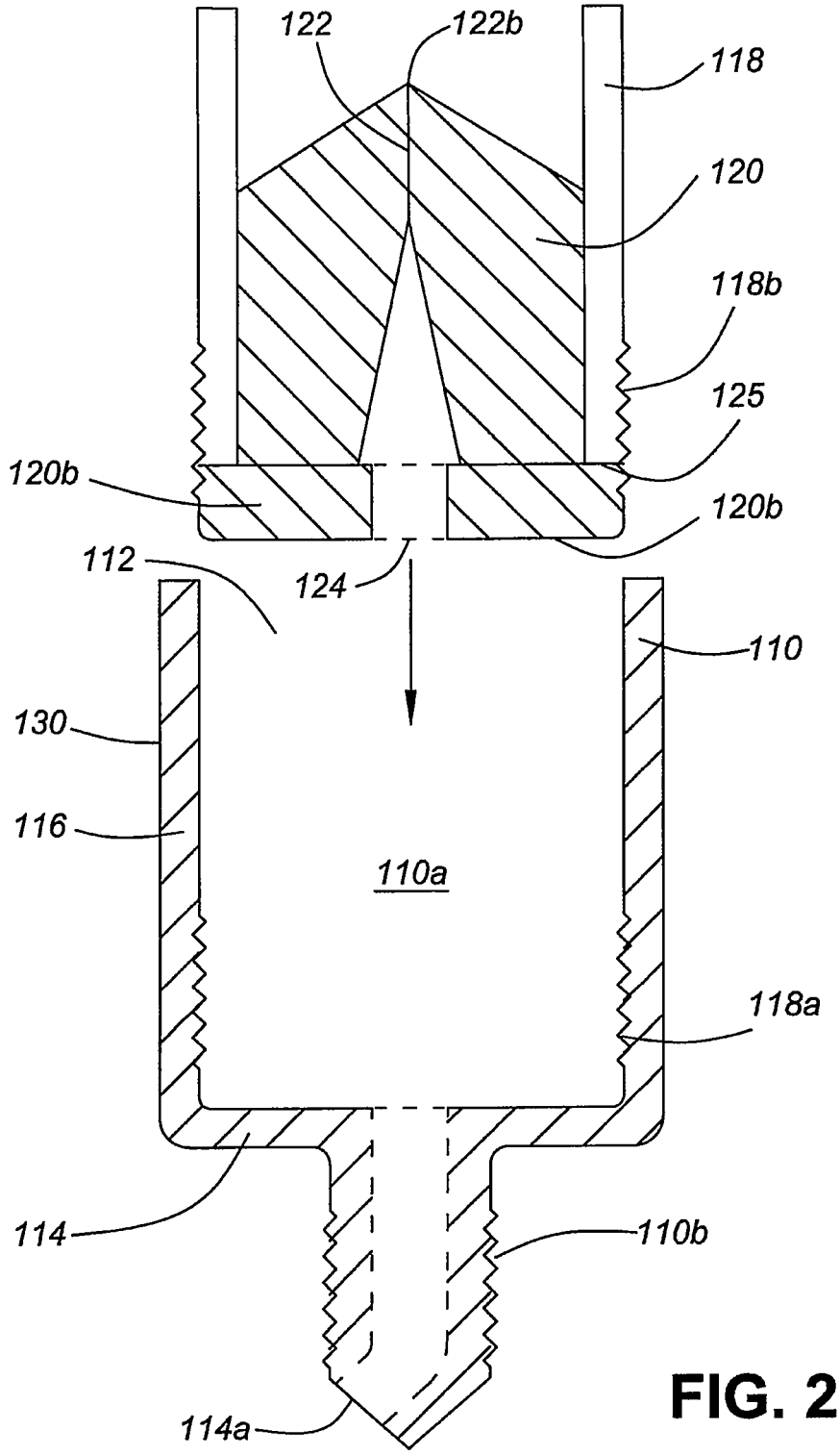
FIG. 2B is a cross-sectional exploded front view of the example of a rail port insert depicted in FIG. 2A.

The elastomeric body 120 comprises a top surface (second end) 120*a*, which may be flat (FIG. 1A), curved, comprise a recess portion (FIG. 1J), or that may be beveled (FIG. 2A). The elastomeric body further comprises a first end, or base, 120*b* (for example FIG. 2A) and 120*c* (FIG. 1E), and a flow passageway 126 having a length that extends from the first end 120*a* to the second end 120*b*. The first end is in fluid communication with the inlet passage of the base 114*a*, and the second end comprising a depth-length 122*a*, the depth-length defining orifice 122. The elastomeric body is made of a resilient, elastomeric material, including, but not limited to, rubber, silicone, polyurethane, high density foam, nitrile, fluorocarbon, isoprene, latex, ethylene propylene, styrene butadiene, polyacrylate, polybutadiene, polyisoprene, fluorosilicone, neoprene and the like. The elastomeric body may also be made of two or more materials, for example, a rigid outer layer that is bonded or fused with, a resilient, flexible central core. The rigid outer layer of the elastomeric body may be a rigid polymeric material or a metal. The elastomeric body 120 may also comprise a relief zone 120*d* (FIG. 1K) that circumscribes, or partially circumscribes, the outer surface of the elastomeric body. The relief zone 120*d* may be located at any location along the outer wall of the elastomeric insert, including the top portion, mid or waist region, or bottom portion of the elastomeric insert 120. The relief zone 210*d* may be used to adjust the flexibility of the elastomeric insert in order to assist opening and closing of the orifice 122.

A flow passageway 126 defining conduit 126*a*, extends between the orifice 122 and the inlet 124 of the elastomeric body 120. The orifice 122 of the elastomeric body 120 has a closed position (for example, FIGS. 1A and 1D) and an open position (for example FIGS. 1B and 1C. When the orifice 122 is in a closed position, conduit 126*a* extends from inlet 124 to second end 122*c* located at the base of orifice 122. When orifice 122 is in an open position, conduit 126*a* extends through the entire elastomeric body 120 from inlet 124 to first end 122*b* located at the top end of the orifice 122.

At least a portion of conduit 126*a* tapers towards orifice 122. For example, as depicted in FIG. 1A, when orifice 122 is in the closed position, conduit 126*a* may comprise a first portion that substantially has a constant diameter, and a second portion that has a changing diameter so that the wall of flow passageway 126 is beveled towards the second end 122*c* located at the base of orifice 122. When orifice 122 is in the open position, as depicted in FIG. 1B, the second portion of conduit 126*a* extends towards the first end 122*b* located at the upper end of orifice 122. The conduit 126*a* also may be beveled from inlet 124, to the second end 122*c* of orifice 122 (see for example, FIGS. 1C, 1H, 1I), the conduit 126*a* may have a cross-sectional diameter that decreases from inlet 124 to the orifice 122, or conduit 126*a* may adopt alternate configurations, for example, it may have a stepped decreased in diameter at one or more locations along the conduit 126*a*. Alternate configuration of conduit 126, may include a general taper from base of the elastomeric body 120*b* to second end 122*c*, is presented in FIGS. 1H, 1I, 2A, 2C, or a recess within the elastomeric body as shown in FIGS. 1J and 1K.

The orifice 122 in the closed position has a depth-length 122*a*. The ratio of the depth-length 122*a* to the length of the beveled conduit 122*d* (see FIGS. 1A and 1H), when the orifice 122 is closed, may be varied to ensure dispensing of the lubricant or friction modifying material through insert 100, while at the same time minimizing evaporation of the friction modifying material or lubricant when orifice 122 is closed. The depth-length 122*a*, and the diameter of conduit 126*a* that is selected should permit flow of a friction control composition or lubricant, when pressure is exerted on the friction control composition or lubricant from an outside pump (via railhead conduit 1*b*, through conduit 126*a*, and out of orifice 122). The depth-length to length of beveled conduit ratio that is selected, should, in absence of any pressure being applied to the friction control composition or lubricant, ensure that orifice 122 remains closed. The ratio of the depth-length 122*a* to the length of the beveled conduit 122*d* may vary depending upon the resiliency or elastic properties of the elastomeric body 120. For example, the ratio of depth length 122*a*:length of beveled conduit 122*d* may be from about 1:100 to about 50:1, or any ratio therebetween. For example, the ratio of depth length 122*a*: length of beveled conduit 122*d* may be from 1:100, 1:95, 1:90, 1:85, 1:80, 1:75, 1:70, 1:65, 1:60, 1:55, 1:50, 1:45, 1:40, 1:35, 1:30, 1:25, 1:20, 1:15, 1:10, 1:8, 1:6, 1:4, 1:2, 1:1, 2:1, 3:1, 4:1, 5:1, 6:1, 7:1, 8:1, 9:1, 10:1, 15:1, 20:1, 25:1, 30:1, 35:1, 40:1, 45:1, 50:1, or any ratio therebetween.

Figure 6A:
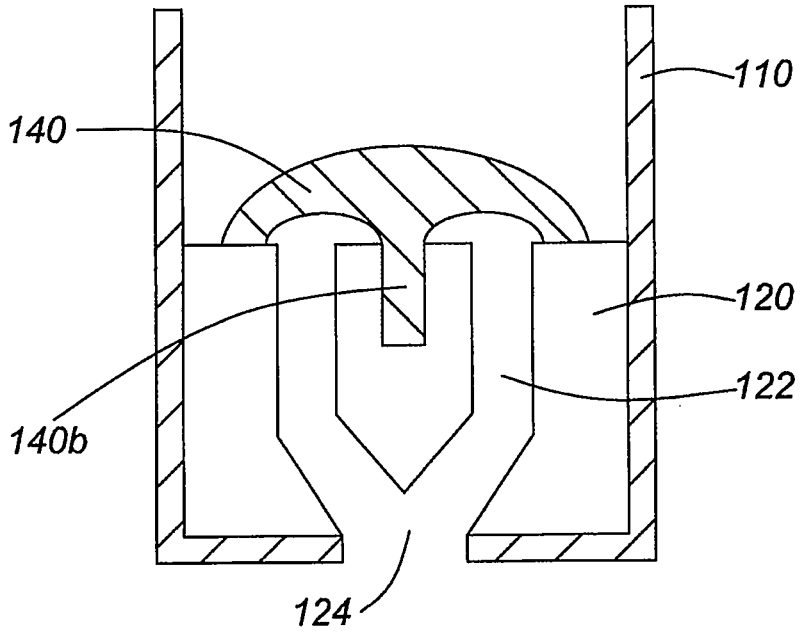
FIG. 6A shows a cross sectional view of another example of a rail port insert comprising an umbrella valve in the closed position.
Figure 6B:
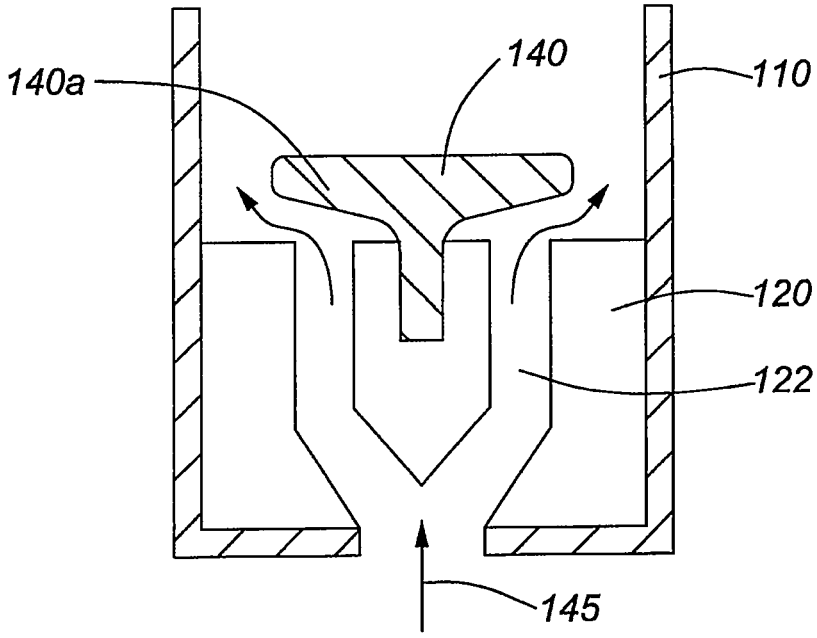
FIG. 6B shows a cross sectional view of the rail port insert with the umbrella valve in the open position.
Figure 6C:
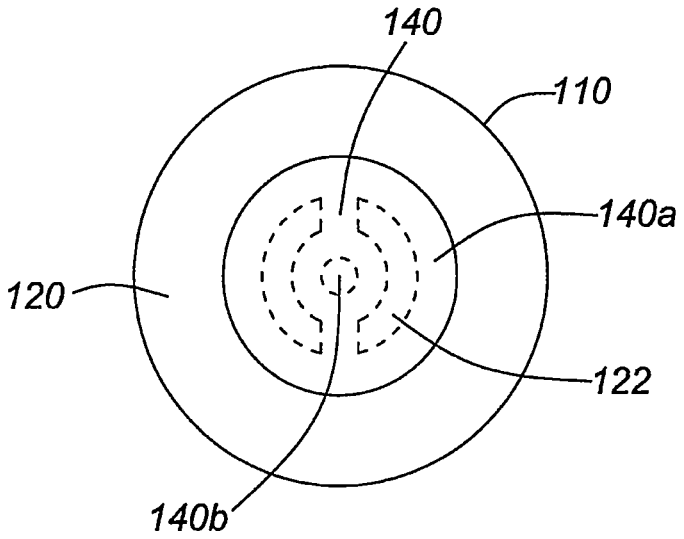
FIG. 6C shows a top view of a rail port insert comprising two orifices and a circular umbrella valve.
Figure 6D:
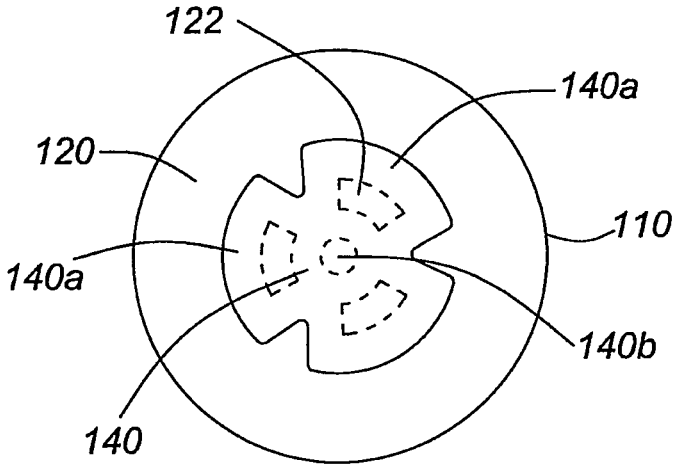
FIG. 6D shows a top view of a rail port insert comprising three orifices and an umbrella valve comprising star-like arms.

An alternative arrangement of the elastomeric body is shown in FIGS. 6A and 6B. In this example, the elastomeric body 120 may comprise a circular orifice 122, or it may comprise one or more tubular or semi circular channels arranged around a central portion of the elastomeric body 120. The elastomeric body 120 further comprises an umbrella valve 140 with one or more arms 140*a*. The arms 140*a* of the umbrella valve 140 are movable from a closed (FIG. 6A) to an open (FIG. 6B) position. The umbrella valve 140 may be made of the same material as the elastomeric body for example, a resilient, elastomeric material, including, but not limited to, rubber, silicone, polyurethane, high density foam, nitrile, fluorocarbon, isoprene, latex, ethylene propylene, styrene butadiene, polyacrylate, polybutadiene, polyisoprene, fluorosilicone, neoprene and the like. In the absence of any flow of friction modifying composition or lubricant through conduit 126 and orifice 122, the arms 140*a* of the umbrella valve 140 are biased to the closed position thereby sealing the orifice opening. When the flow 145 of the friction modifying composition or lubricant increases, and the pressure within orifice 122 exceeds the resiliency of the arms 140*a* of the umbrella valve 140, the arms 140*a* of the umbrella valve 140 are forced to the open position thereby permitting flow of the friction modifying composition or lubricant out of the elastomeric body 120, past arms 140*a* and the rail port insert 100 and onto the railhead. The umbrella valve 140 may, when viewed from a top view, be circular in shape so that the arms 140*a* form a continuous circular ridge around the central stem 140*b* of the umbrella valve 140 (FIG. 6C). However, if the orifice 122 of the elastomeric body 120 comprises one or more tubular or semi circular channels arranged around a central portion of the elastomeric body 120, then the umbrella valve 140 may comprise one or more arms 140*a*, attached to the central stem 140*b*, that are arranged to cover a corresponding opening of each of the one or more tubular channels (FIG. 6D). In this configuration the umbrella valve 140 comprises one or more arms 140*a*, each overlay a corresponding channel opening, and when viewed from a top view, may appear star-like in shape. The umbrella valve 140 may be formed so that it is integral with the elastomeric body 120, or the umbrella valve may be secured to the elastomeric body by central stem 140*b*.

The elastomeric body 120 may be press fit into the spatial volume 110*a* of outer casing 110. When elastomeric body 120 is press-fitted within the spatial volume 110*a*, a lateral compression force against at least a portion of the elastomeric body 120 and at least along the depth length 122*a* of orifice 122 is established, thereby biasing orifice 122 in the closed position. When elastomeric body 120 is press-fitted within the spatial volume 110*a*, the body inlet 124 is fluidly communicative with outer casing inlet passage 114*a*.

Alternatively, elastomeric body 120 may be mechanically coupled (for example by a C-clip, one or more pin, threaded attachment), adhesively coupled, or chemically bonded to outer casing 110 by methods known to one of skill in the art, provided that, when installed, a lateral compression force is exerted against the elastomeric body 120, and at least along the depth length 122*a* of orifice 122 is established to bias orifice 122 to the closed position when the pressure to the friction control composition or lubricant is below a certain threshold pressure, or the pressure is removed. As shown in FIG. 1I, elastomeric body 120 may also include an extension of base 120*c* that is press fit through inlet 114*a* and overlaps the base of casing 114 thereby retaining elastomeric body 120 within outer casing 110, provided that, when installed, a lateral compression force is exerted against the elastomeric body 120, and at least along the depth length 122*a* of orifice 122 is established to bias orifice 122 to the closed position when the pressure to the friction control composition or lubricant is below a certain threshold pressure, or the pressure is removed.

Insert 100 may be threadedly engaged with the railhead outlet port 1 using threaded engagements 110*b*. Alternatively, elastomeric body 120 may be press fit, mechanically coupled, adhesively coupled, or chemically bonded to wall 2 of the railhead port 1, directly, without using outer casing 110. For example, if elastomeric body 120 is made of two or more materials, for example, a rigid outer layer that is bonded or fused to, a resilient, flexible inner layer, or central core, then the rigid outer layer of the elastomeric body 120 may, in addition to the above mentioned attachment options, comprise threaded engagement 110*b*, or the bi-layered elastomeric body may be press-fit into railhead port 1.

When fully engaged with the railhead outlet port 1, insert 100 resides within the railhead outlet port 1 and does not protrude past the mouth 1*a* of the railhead outlet port 1 (see FIG. 1G). When disposed within the outlet port 1, inlet 124 and outer casing inlet passage 114*a* are in fluid communication with a railhead conduit 1*b*. Railhead conduit 1*b* is also in fluid communication with a reservoir (not shown) containing a friction modifying material or lubricant.

When signaled by a first mechanism, for example, but not limited to those described in WO 2011/143765, WO2013/067628, U.S. Pat. No. 7,841,400, (each of which are incorporated herein by reference), friction modifying material or lubricant is directed from the reservoir, through railhead conduit 1*b* in rail head 5, towards the inlets 114*a* and 124, and enters conduit 126*a*. As the lubricant or other friction modifying material flows through the beveled portion of conduit 126*a*, pressure is exerted against the walls of the beveled portion of conduit 126*a* until a compression force against the length 122*a* is overcome and orifice 122 is opened (see FIGS. 1C and 1D). When the orifice 122 is opened, the lubricant or other friction modifying material flows onto the top surface 120*a* of the elastomeric body 120, and becomes available for transfer to the surface of passing rail wheel.

When signaled by a second mechanism known in the art, for example but not limited to those described in WO 2011/143765, WO2013/067628, U.S. Pat. No. 7,841,400 (each of which is incorporated herein by reference), the flow of lubricant or other friction modifying material through the conduit 126*a* is reduced and the pressure against the walls of the beveled portion of conduit 126*a* decreases. As a result, the compressive force exerted on the elastomeric material of the body 120 by casing wall 116, overcomes the pressure exerted by the lubricant or other friction modifying material against the inner walls of the conduit 126*a*, and orifice 122 re-closes along depth-length 122*a*.

Therefore another example of a rail port insert is provided that comprises, an elastomeric body having a first end and a second end, a rigid outer layer fused to a resilient, flexible central core, the elastomeric body comprising a flow passageway within the central core, the flow passageway having a length extending from the first end to the second end, the first end defining an inlet in fluid communication with the flow passageway, the second end comprising a depth-length and defining an orifice along the depth-length and in fluid communication with the flow passageway, the orifice moving from a closed position in the absence of any applied pressure within the flow passageway, to an open position when pressure is applied within the flow passageway, when the rail port insert is installed in a railhead port, the inlet is in fluid communication with a railhead conduit.

Referring to FIGS. 2A, 2B, 2F, 2G, 2H and 2I there is provided an alternate embodiment, of rail port insert 100 comprising an outer casing 110, an elastomeric body 120, and a retainer 118. The retainer 118 functions in maintaining the elastomeric body within the outer casing 110 as described below.

The rail port insert is similar to that as described above and comprises an outer casing 110 with an open end 112, a base 114 opposite a top end of the outer casing, sidewalls 116 extending between the base 114 and the top end of the outer casing, and an inlet passage 114*a* that extends through base 114 of the outer casing 210. The sidewalls 116 and the base 114 define a spatial volume 110*a* of outer casing 110. The outer casing 110 and the retainer 118 are manufactured of a material that is suitable for withstand repeated impact by a railroad car wheel. Materials suitable for such application include, but not limited to, a metal, a metal alloy, fiber (for example, carbon fiber or glass fiber) reinforced plastic, or a plastic. Threaded engagements 110*b* may circumscribe, or partially circumscribe walls 116 (for example as shown in FIGS. 2F, 2G), or the base 114 (for example as shown in FIG. 2A), of the outer casing 110, and engage complementary threaded engagements (not numbered) located within the railhead outlet port 1 of railhead 5. If the railhead port does not comprise a complementary threaded engagement, then the existing railhead port may be modified so that a complementary threaded portion is introduced, for example by a tap, to receive the threaded engagement 110*b*.

Alternatively, outer casing 110 may engage outlet port 1 by a locking mechanism or other method known in the art, for example a C-clip, a pin, or by press fitting an oversized insert 100 into port 1 so that a frictional engagement is established between the insert 100 and the wall of port 1.

The elastomeric body 120, made of similar elastomeric materials to that as described above, for example a resilient, elastomeric material, including, but not limited to, rubber, silicone, polyurethane, high density foam, nitrile, fluorocarbon, isoprene, latex, ethylene propylene, styrene butadiene, polyacrylate, polybutadiene, polyisoprene, fluorosilicone, neoprene and the like, comprises an orifice 122, an inlet 124, a flow passageway 126 that extends between orifice 122 and inlet 124, as described above. The elastomeric body 120 may be press-fit with retainer 118, so that the sides comprising orifice 122 are pressed closed when the elastomeric body 120 is inserted within retainer 118. Alternatively, the elastomeric body, or check valve, 120 may be a self-closing nozzle, such as a duckbill self-closing valve, for example as described in U.S. Pat. No. 4,524,805 (which is incorporated herein by reference). In this alternative example, orifice 122 of the self-closing nozzle comprises an inherent elastomeric retentive force that biases it to a closed position (see for example, FIG. 2G).

In another example, elastomeric body 120 may comprise a circular flange at base 120*b* that has a larger outer diameter than the outer diameter of the main body of the elastomeric body 120 (FIGS. 2A-2G). In this embodiment, when the elastomeric body 120, or self closing nozzle, is inserted within retainer 118, the bottom portion of the retainer 118 fits against an upper surface of the circular flange 125 of the elastomeric body 120. In this way, when the elastomeric body 120 is placed within retainer 118, and the retainer is inserted within outer casing 110, the elastomeric body 120 is secured within the outer casing 110 by retainer 118 at circular flange 125.

In use, elastomeric body 120, or the self-closing nozzle, is inserted into retainer 118 so that the upper surface of circular flange 125 fits against the base of retainer 118. The retainer fitted with the elastomeric body are then inserted into the spatial volume 110*a* of outer casing 110. In the example shown in FIGS. 2A, 2B, and 2F, threaded engagements 118*a* circumscribe at least a portion of the inner surface of the sidewall 116 of the outer casing 110, and complementary threaded engagements 118*b* circumscribe at least a portion of the outer surface of the retainer 118. Threaded engagements 118*a* and complementary threaded engagements 118*b* mate to secure retainer 118 within the spatial volume 110*a* of outer casing 110. When the elastomeric body 120 and retainer 118 are fully engaged with the outer casing 110, the body inlet 124 is in fluid communication with outer casing inlet passage 114*a*. Retainer 118 may also engage outer casing 110 by a locking mechanism or other method known in the art, for example a C-clip, a pin, or by press fitting an oversized retainer 118 into outer casing 110 so that a frictional engagement is established between the retainer 118 and wall 116. When retainer 118 is secured to outer casing 110, elastomeric body 120 is secured within the rail port insert 100.

Figure 2C:
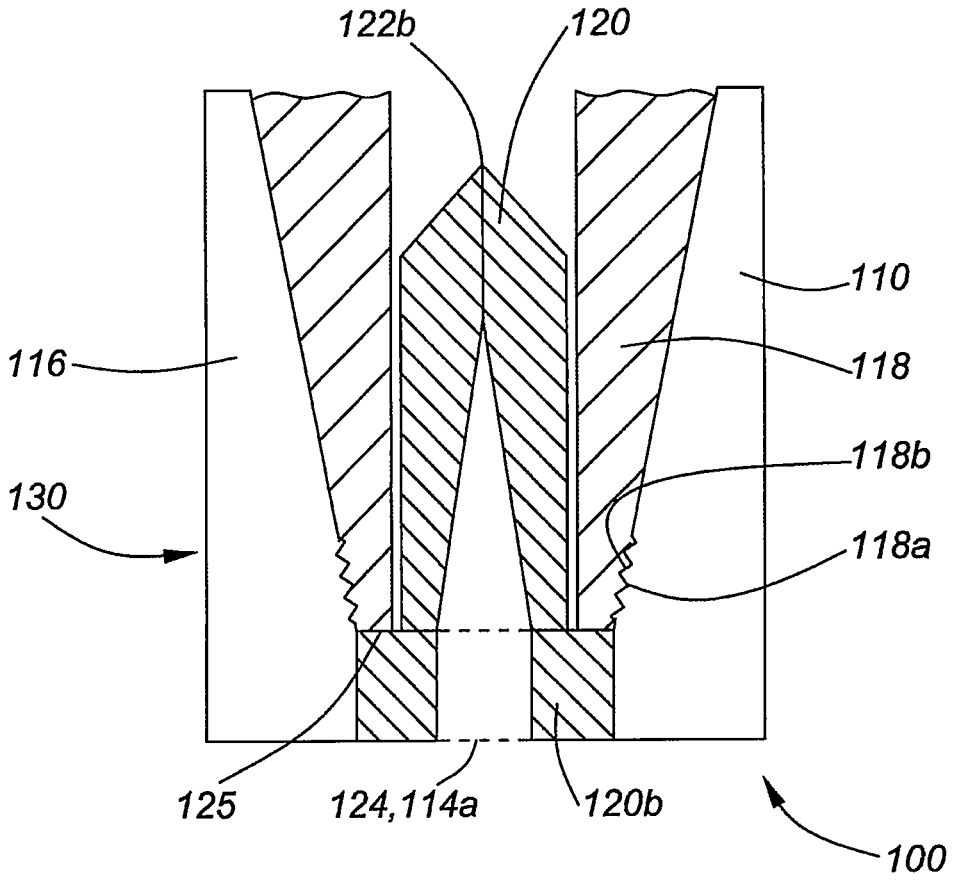
FIG. 2C is a cross-section front view of another example of a rail port insert as described herein comprising a beveled (conical shaped) retainer located within an outer casing comprising a beveled inside wall.
Figure 2D:
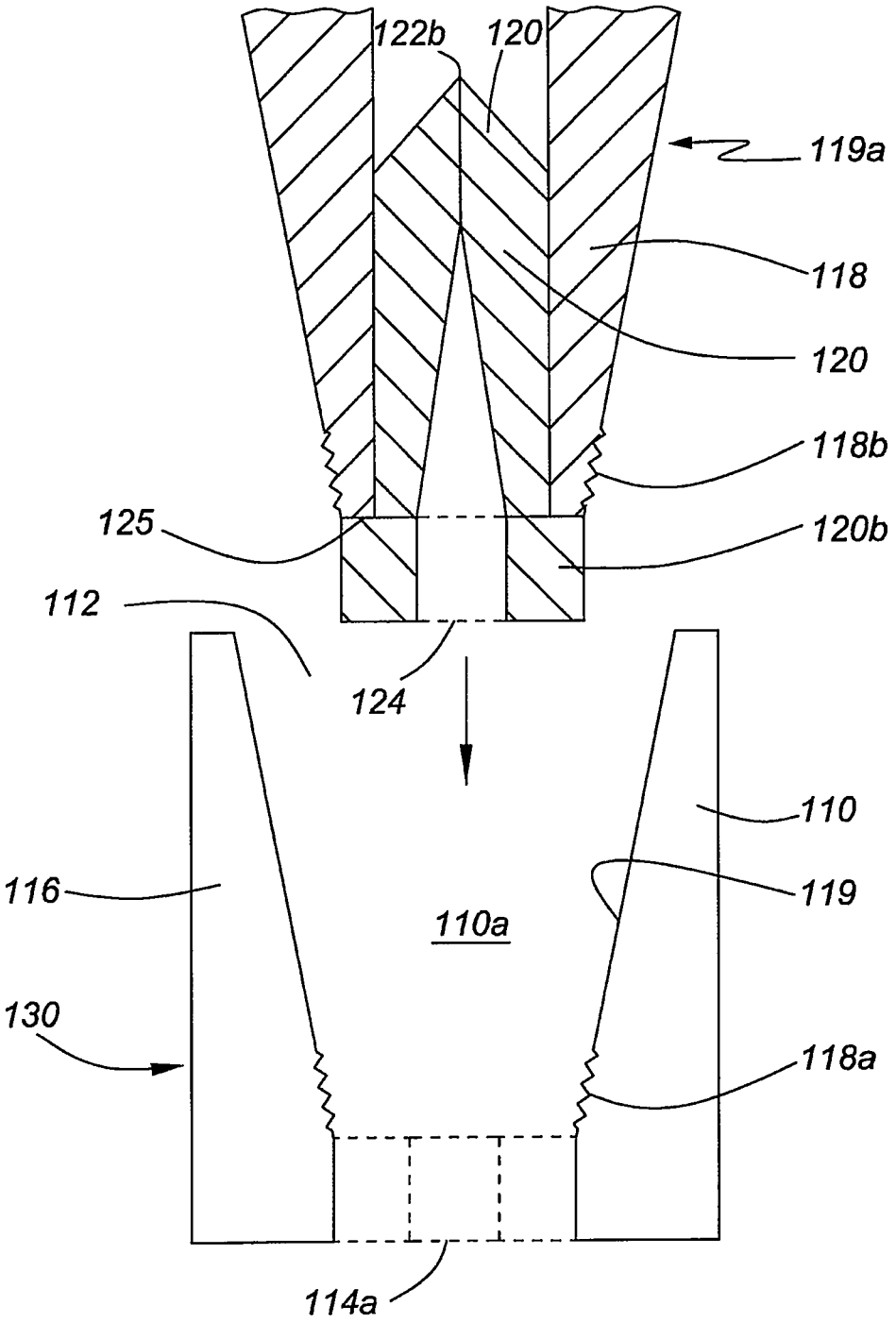
FIG. 2D is a cross-sectional exploded front view of the example of a rail port insert depicted in FIG. 2C.

Other arrangements for locking outer casing 110 to outlet port 1 is shown in FIGS. 2C and 2D. In this example, rail port insert 100 comprises an outer casing 110 that is characterized as having a beveled inner surface 119 that forms an inverted cone (FIG. 2D), a retainer 118 having beveled outer surface 119*a* forms a conical shape for matingly engaging the inverted cone of the outer casing 110, and an elastomeric body 120. The elastomeric body 120 may have an orifice 122 that is pressed closed as a result of engagement with walls of retainer 118, or it may be a self-closing nozzle, such as a duckbill self-closing valve, for example as described in U.S. Pat. No. 4,524,805 (which is incorporated herein by reference). Threaded engagements 118*b* circumscribe, or partially circumscribe the base of retainer 118. The threaded engagements 118*b* engage complementary threaded engagements 118*a* of the inner wall 119 of the outer casing 110. When the elastomeric body 120, or self closing nozzle, is inserted within retainer 118, the bottom portion of the retainer 118 fits against the upper surface of the circular flange 125. In this way, when the elastomeric body 120 is placed within retainer 118, and the retainer is inserted within outer casing 110, the elastomeric body 120 is secured within the outer casing 110 by retainer 118 at circular flange 125 (FIG. 2C).

In use, the rail port insert 100 as shown in FIG. 2C is placed within the railhead outlet port 1 of rail 5 and the retainer 118 is secured to the outer casing 110 by engaging threaded engagements 118*b* and 118*a*. As the retainer 118 is threaded into outer casing 110, the beveled outer wall 119*a*, of retainer 118, presses against the beveled inner wall 119 of the outer casing 110, and forces outer wall 130, of outer casing 110, against the wall 2 of the railhead outlet port 1, thereby securing retainer 118 to the outer casing 110, and the rail port insert 100 to the railhead outlet port 1. The rail port insert 100 may be removed from railhead port 1 by reversing these steps. The rail port insert 100 may further comprise a portion of the sidewall that protrudes above rail when installed and that comprises flats, or tabs that are used to install or tighten the rail port insert into the railhead port. After installation, the protruding portion may be removed, for example by grinding the protruding portion flush to the railhead surface.

Figure 2E:
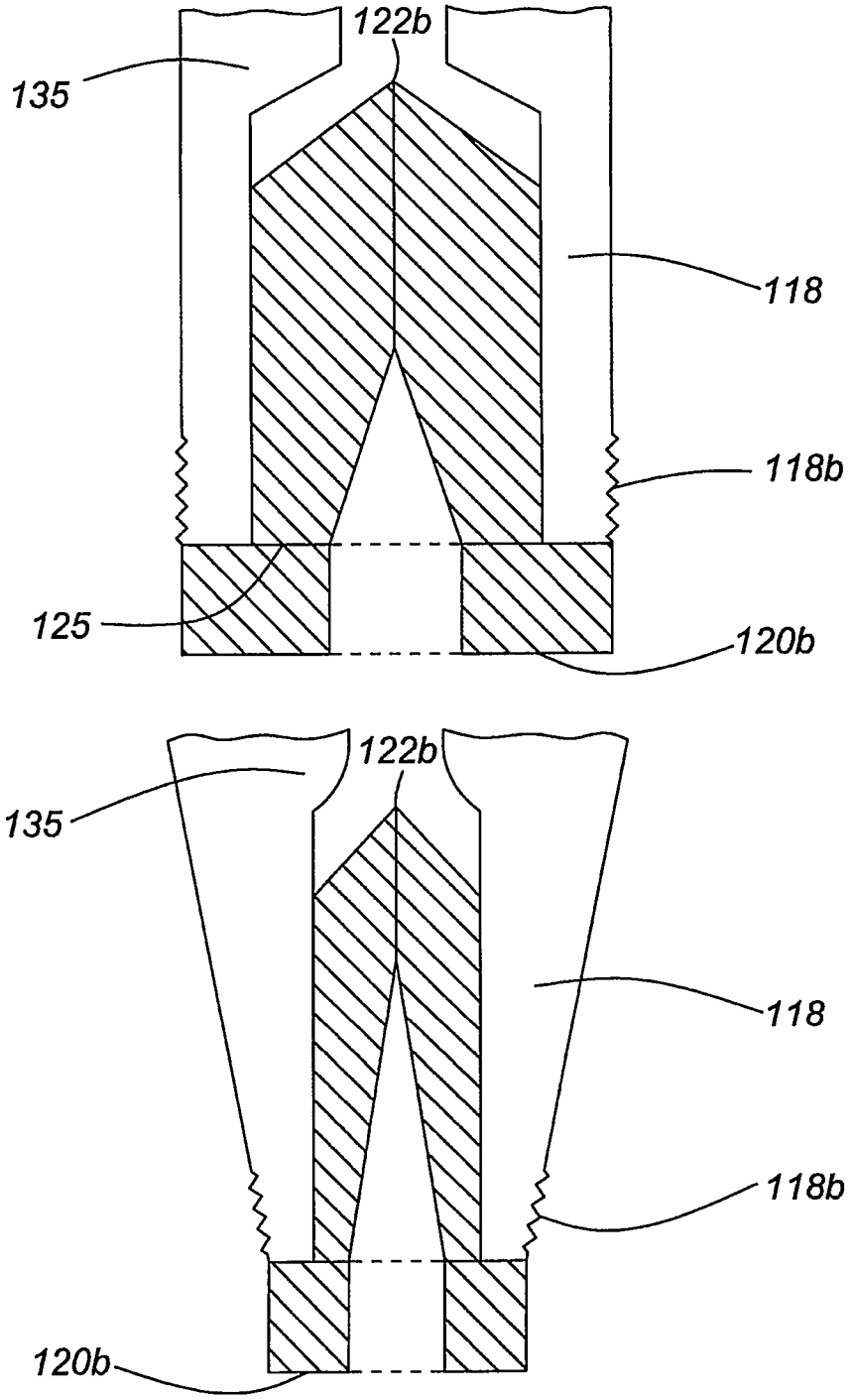
FIG. 2E shows two cross-sectional front views of additional examples of a rail port insert as described herein. The rail port inserts comprise a retainer that is located within the outer casing, the retainer further comprising a flange circumscribing the inner surface of the upper retainer wall. Upper panel of FIG. 2E is analogous to the portion of the rail port insert shown in FIG. 2B, and the lower panel of FIG. 2E shows a portion of the rail port insert analogous to that shown in FIG. 2D.
Figure 2F:
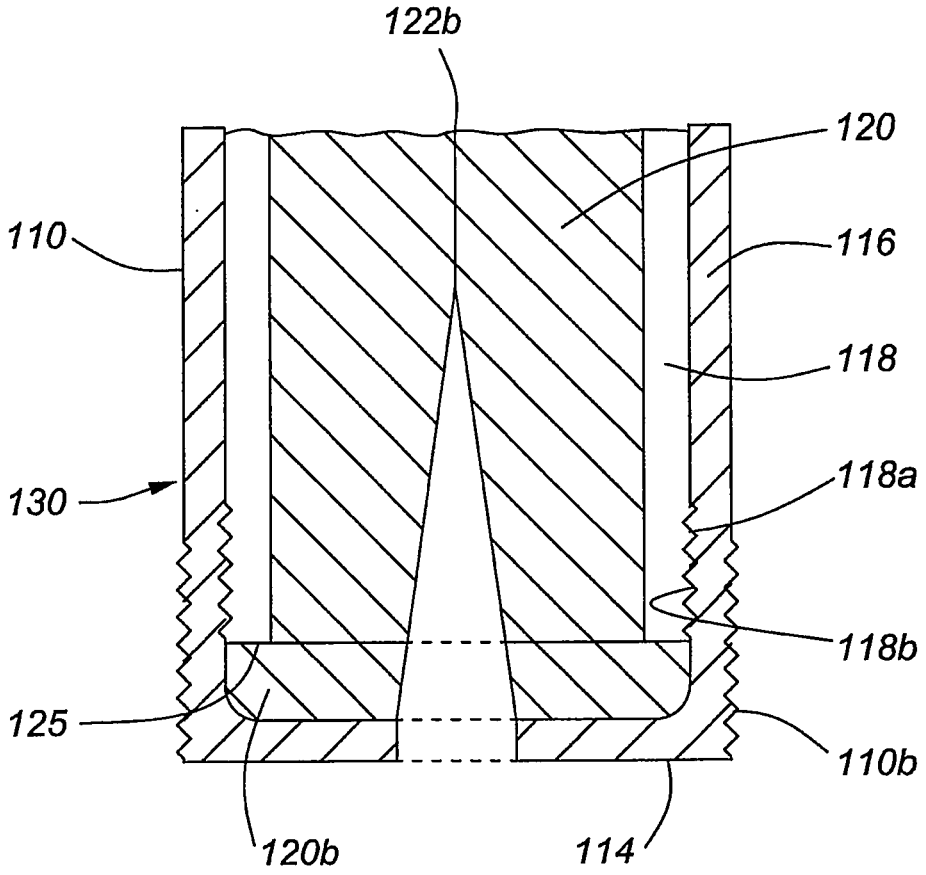
FIG. 2F shows a cross-sectional front view of another example of a rail port insert as described herein comprising an elastomeric body positioned within a retainer that is located within the outer casing. The elastomeric body has a top surface that is flush with the top of the rail port insert.
Figure 2G:
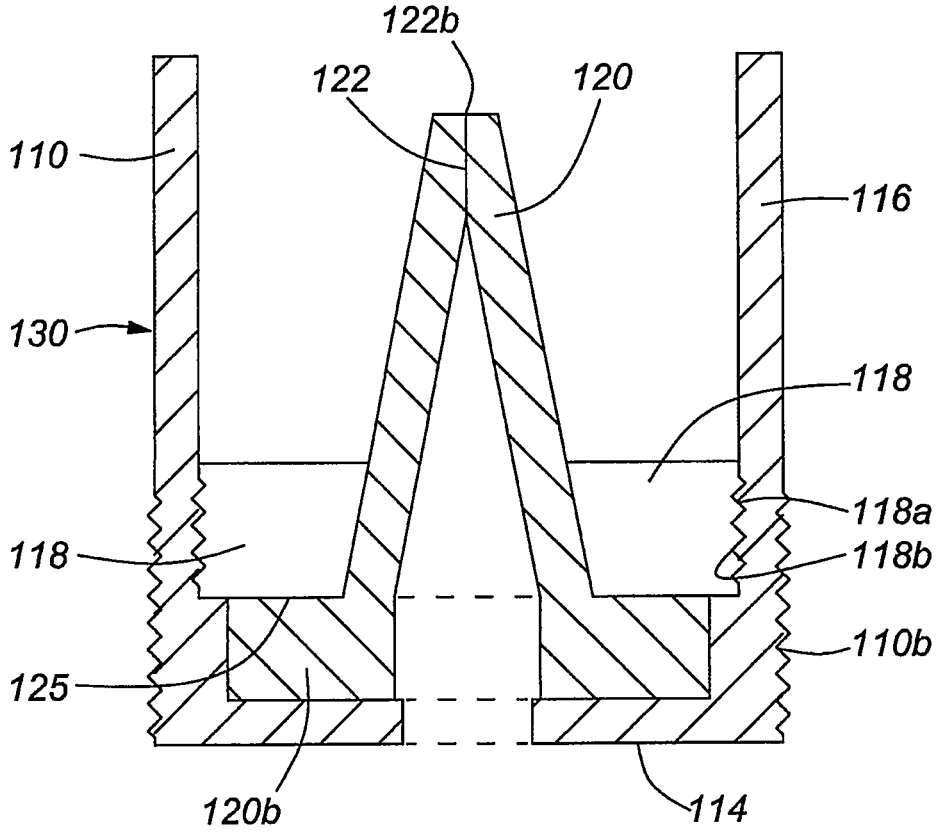
FIG. 2G shows a cross-sectional front view of another example of a rail port insert as described herein comprising a tapered elastomeric body positioned within a retainer that is located within the outer casing.
Figure 2H:
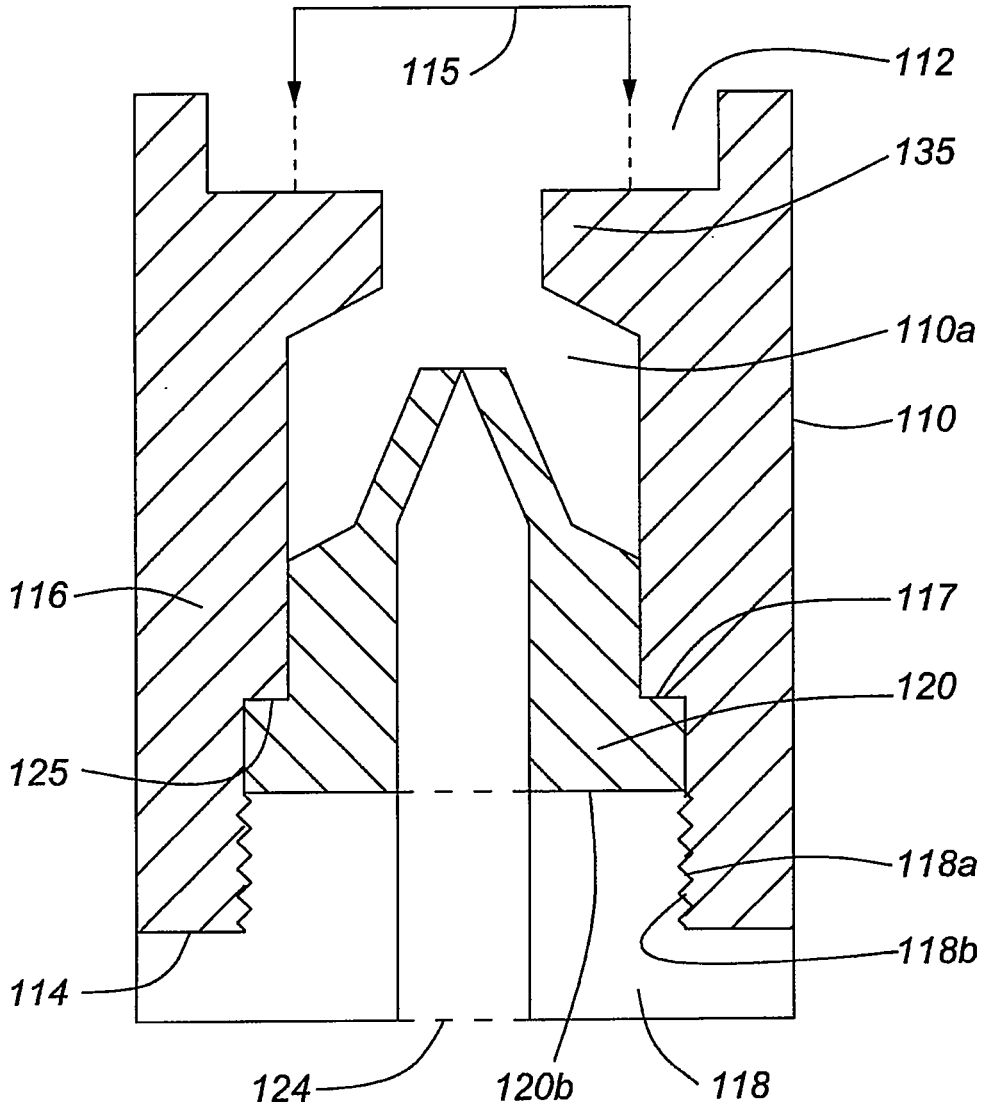
FIG. 2H shows a cross-sectional front view of another example of a rail port insert as described herein comprising a retainer engaged with the base of the outer casing of the insert and a flange of an elastomeric body.

When elastomeric body 120 is fully inserted within retainer 118, and engaged with outer casing 110, orifice 122 may reside within the spatial volume 110*a* so that top of orifice, 122*b*, resides below a plane defined by the top end of wall 116 of outer casing 110 that would be flush with the rail head surface when the rail port insert 100 is placed within the rail port 1 of the rail head 5, for example, as shown in FIG. 2A. If accumulation of debris within the volume located above the top surface of the elastomeric body and bounded by the side walls 116 of retainer 118, is of concern, then the inner wall of retainer 118 may include an extension, for example a ring or flange 135 (FIGS. 2E, 2H) that circumscribes the inner wall of sidewall 116. The ring 135 may comprise an inclination on its undersurface that is complementary to the inclined top surfaces of elastomeric body 120. Flange 135 may be formed as part of the retainer as shown in FIG. 2E, or flange 135 may be made of a different material and adhesively attached or mechanically coupled to the inner wall of the retainer 118. For example, flange 135 may include threads on its outer wall that engage with threads located at the top of the inner wall of retainer 118. Flange 135 may be made of the same material as the retainer, or it may be made from a rubber or polyurethane, silicone, material or a similar manner to that of the elastomeric insert. When installed, inlet 124 of rail port insert 100, and inlet 114*a* are fluidly communicative with railhead conduit 1*b* (FIG. 1G). Conduit 1*b* is connected to a reservoir (not shown) that stores lubricant or other friction modifying material.

Alternatively, when the elastomeric body 120 is fully inserted within retainer 118, and engaged with the outer casing 110, the top surface of the elastomeric body may be positioned so that it is flush with the rail head surface when the rail port insert 100 is placed within the rail port 1 of the rail head 5, in a manner analogous to that shown in FIG. 1C, 1D or 2F.

Figure 2I:
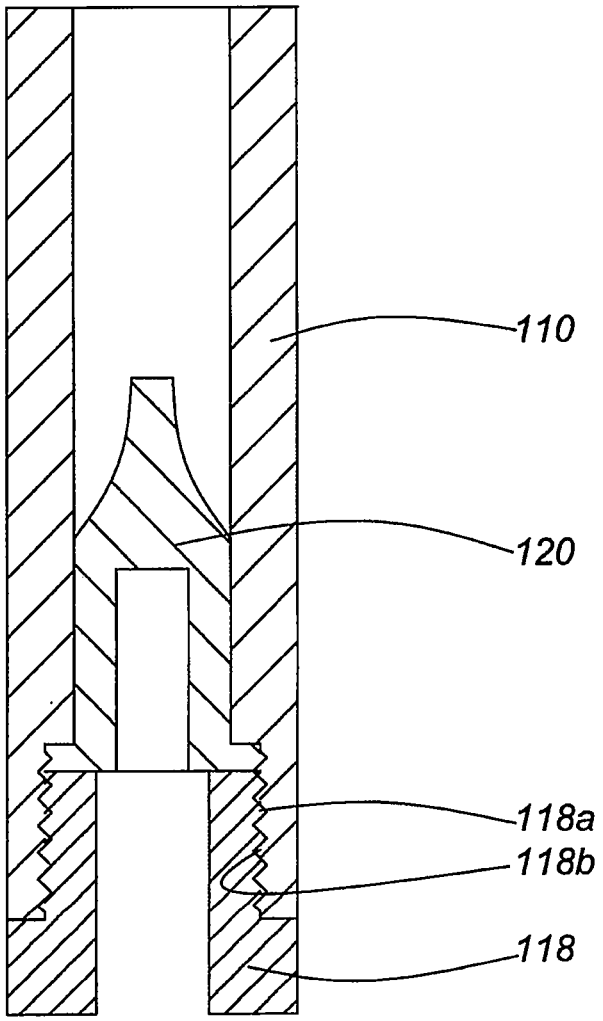
FIG. 2I shows a cross-sectional front view of another example of a rail port insert as described herein comprising a retainer engaged with the base of the outer casing of the insert and a flange of an elastomeric body.

In another example, the elastomeric body 120 may comprise a circular flange 125 at base 120*b* that fits against flange 117 of inner wall of sidewall 116 (FIG. 2H, 2I). The elastomeric body 120, or self closing nozzle, is inserted within the outer casing of the insert 110, the top surface of the flange 125 of the elastomeric body 120 fits against the bottom surface of a flange 117 of an inner wall of side wall 116 of the outer casing 110, and retainer 118 is engaged with the outer casing 110 so that the top surface of the retainer 118 fits against a bottom surface 120*b* of the elastomeric body 120. In this way, when the elastomeric body 120 is placed within retainer 118, and the retainer is inserted within outer casing 110, the elastomeric body 120 is secured within the outer casing 110 by retainer 118 at circular flange 125. In a manner similar to that shown in FIGS. 2A, 2B, and 2F, threaded engagements 118*a* circumscribe at least a portion of the inner surface of the sidewall 116 of the outer casing 110, and complementary threaded engagements 118*b* circumscribe at least a portion of the outer surface of the retainer 118. Threaded engagements 118*a* and complementary threaded engagements 118*b* mate to secure retainer 118 to the outer casing 110. Retainer 118 may also engage outer casing 110 by a locking mechanism or other method known in the art, for example a C-clip, a pin, or by press fitting an oversized retainer 118 into outer casing 110 so that a frictional engagement is established between the retainer 118 and wall 116. When retainer 118 is secured to outer casing 110, elastomeric body 120 is secured within the rail port insert 100.

If the rail port insert 100 is inserted within the railhead so that the walls of the outer casing of the insert 116 are flush with the top of the railhead, then as shown for example in FIG. 2H, the opening 112 defined by the top of the insert 110 may comprise a reset (or chamfered edge, not shown), relative to the outer diameter 115 of the main conduit traversing the insert 110*a*, so that the edge is reset back from the outer diameter 115 of the conduit from about 0 to about 8 mm, or any amount therebetween, for example from about 0, 0.5, 1.0, 2.0, 3.0, 4.0, 5.0, 6.0, 7.0, 8.0 mm or any amount therebetween. Over time, the edges of the top of the outer casing will deform, or lip, as a result of the passage of train wheels. The reset opening of the outer casing may be drilled out as required to remove any flanged, lipped or deformed edges during regular maintenance.

When installed, inlet 124 of rail port insert 100, and inlet 114*a* are fluidly communicative with railhead conduit 1*b* (FIG. 1G). Conduit 1*b* is connected to a reservoir (not shown) that stores lubricant or other friction modifying material.

In a similar manner as described above, when signaled by a first mechanism, for example, but not limited to those described in WO 2011/143765, WO2013/067628, U.S. Pat. No. 7,841,400, (each of which are incorporated herein by reference), friction modifying material or lubricant is directed from the reservoir, through railhead conduit 1*b* in rail head 5, towards the inlets 114*a* and 124, and enters conduit 126*a*. As the lubricant or other friction modifying material flows through the beveled portion of conduit 126*a*, pressure is exerted against the walls of the beveled portion of conduit 126*a*, or a self-closing nozzle (for example as described in U.S. Pat. No. 4,524,805, which is incorporated herein by reference), until orifice 122 is opened. When the orifice 122 is opened, the lubricant or other friction modifying material flows onto the top surface 120*a* of the elastomeric body 120, and becomes available for transfer to the surface of passing rail wheel. When signaled by a second mechanism known in the art, for example but not limited to those described in WO 2011/143765, WO2013/067628, U.S. Pat. No. 7,841,400 (each of which are incorporated herein by reference), the flow of lubricant or other friction modifying material through the conduit 126*a* is reduced and the pressure against the walls of the beveled portion of conduit 126*a*, or self-closing nozzle, decreases. As a result, the compressive force exerted on the elastomeric material of the body 120 by casing wall 116, or within the self-closing nozzle, overcomes the pressure exerted by the lubricant or other friction modifying material against the inner walls of the conduit 126*a*, and orifice 122 re-closes along depth-length 122*a*.

Therefore, another example of a rail port insert is described that comprises, an outer casing comprising a tubular sidewall and a base, the sidewall and base defining a spatial volume therein, the base defining an inlet passage that extends through the base and that is fluid communication with the spatial volume, a tubular retainer that is disposed within the spatial volume so that an outer wall of the retainer is affixed to an inner surface of the tubular sidewall, the tubular retainer defining an open top end and an open bottom end, an elastomeric body having a first end and a second end, the elastomeric body comprising a circular flange at the first end, the circular flange having an upper surface and a lower surface, the elastomeric body disposed within the retainer so that the upper surface of the circular flange sits against the bottom end of the retainer, and the lower surface of the circular flange sits against the base, the elastomeric body comprising a flow passageway having a length extending from the first end to the second end, the first end in fluid communication with the inlet passage of the base, the second end further comprising a depth-length and defining an orifice along the depth-length, the orifice moving from a closed position in the absence of any applied pressure within the flow passageway, to an open position when pressure is applied within the flow passageway, so that, when the rail port insert is installed in a railhead port, the inlet of the outer casing is in fluid communication with a railhead conduit.

It is contemplated that any part of any aspect or embodiment discussed in this specification can be implemented or combined with any part of any other aspect or embodiment discussed in this specification. While particular embodiments have been described in the foregoing, it is to be understood that other embodiments are possible and are intended to be included herein. It will be clear to any person skilled in the art that modification of and adjustment to the foregoing embodiments, not shown, is possible.

What is claimed is:

1. A rail port insert comprising:

an outer casing comprising a tubular sidewall and a base, the sidewall and base defining a spatial volume therein, the base defining an inlet passage that extends through the base and that is fluid communication with the spatial volume, an elastomeric body having a first end and a second end, the elastomeric body disposed within the spatial volume and affixed to an inner surface of the tubular sidewall, the base, or both an inner surface of the tubular sidewall and the base, the elastomeric body comprising a flow passageway having a length extending from the first end to the second end, the first end in fluid communication with the inlet passage of the base, the second end further comprising a depth-length and defining an orifice along the depth-length, the orifice moving from a closed position in the absence of any applied pressure within the flow passageway, to an open position when pressure is applied within the flow passageway, when the rail port insert is installed in a railhead port, the inlet of the outer casing is in fluid communication with a railhead conduit.

2. The rail port insert of claim 1, wherein at least a portion of the flow passageway is bevelled from the first end to the second end, so that when the orifice is in the closed position, a beveled conduit is formed that has a beveled length extending from the first end to a bottom of the depth-length.

3. The rail port insert of claim 2, wherein when the orifice is the closed position, the depth-length to beveled length ratio is from about 1:100 to about 50:1.

4. The rail port insert of claim 3, wherein the outer casing comprises a threaded engagement circumscribing at least a portion of an outer surface of the tubular sidewall.

5. The rail port insert of claim 3, wherein the elastomeric body is press-fit within the inner surface of the tubular sidewall.

6. The rail port of claim 3, wherein the elastomeric body comprises an extension at the second end, the extension passing through and overlapping a bottom surface of the base.

7. The rail port insert of claim 3, wherein the outer casing comprises a threaded engagement circumscribing at least a portion of an outer surface of the tubular wall.

8. The rail port insert of claim 1, wherein the rail port insert further comprises a retainer that is disposed within the spatial volume so that an outer wall of the retainer is affixed to an inner surface of the tubular sidewall, the retainer defining an open top end and an open bottom end, the elastomeric body comprising a circular flange at the first end, the circular flange having an upper surface and a lower surface, so that:

i) the elastomeric body disposed within the retainer so that the upper surface of the circular flange sits against the bottom end of the retainer, and the lower surface of the circular flange sits against the base, or ii) the elastomeric body is disposed within the spatial volume so that the upper surface of the circular flange sits against a flange positioned on an inner wall of the outer casing and the lower surface of the circular flange sits against the upper end of the retainer.

9. The rail port insert of claim 8 wherein the retainer is press-fit so that the outer wall of the retainer is frictionally engaged within the inner surface of the tubular sidewall of the outer casing.

10. The rail port insert of claim 8 wherein the retainer comprises a threaded engagement on an outer surface, and the outer casing comprises a corresponding threaded engagement circumscribing at least a portion of the inner surface of the tubular sidewall.

11. The rail port insert of claim 10, wherein the retainer is cone shaped and outer surface of the retainer is beveled from the top end to the bottom end, and the inner surface of the tubular sidewall is beveled forming an inverted cone that matingly engages the outer surface of the retainer.

12. The rail port insert of claim 8, wherein an inner wall at the top end of the retainer further comprises a circular flange that extends towards a center of the retainer, the flange defining an opening located above the orifice.

13. A method of inserting the rail port insert of claim 8 into a railhead outlet port, comprising, inserting the rail port insert into the rail head outlet port, and coupling the rail port insert to the railhead outlet port.

14. The method of claim 13, wherein the in the step of coupling, a threaded engagement on an outer surface of the retainer matingly engages a corresponding threaded engagement circumscribing at least a portion of the inner surface of the tubular sidewall, and tightening of the retainer forces the tubular sidewall against a wall of the railhead port.

15. A method of inserting the rail port insert of claim 1 into a railhead outlet port, comprising, inserting the rail port insert into the rail head outlet port, and coupling the rail port insert to the railhead outlet port.

16. The method of claim 15, wherein in the step of coupling, the rail port insert is threadedly engaged within the railhead outlet port.

17. A rail port insert comprising:

an elastomeric body having a first end and a second end, a rigid outer layer fused to a resilient, flexible central core, the elastomeric body comprising a flow passageway within the central core, the flow passageway having a length extending from the first end to the second end, the first end defining an inlet in fluid communication with the flow passageway, the second end comprising a depth-length and defining an orifice along the depth-length and in fluid communication with the flow passageway, the orifice moving from a closed position in the absence of any applied pressure within the flow passageway, to an open position when pressure is applied within the flow passageway, when the rail port insert is installed in a railhead port, the inlet is in fluid communication with a railhead conduit.

18. The rail port insert of claim 17, wherein the outer rigid layer comprises a threaded engagement circumscribing at least a portion of an outer surface of the rigid outer layer.

19. A method of inserting the rail port insert of claim 17, into a railhead outlet port, comprising, inserting the rail port insert into the rail head outlet port; and coupling the rail port insert to the railhead outlet port.

20. The method of claim 19, wherein in the step of coupling, the rail port insert is threadedly engaged within the railhead outlet port.

* * * * *